US011198574B2

(12) United States Patent
Suzuki et al.

(10) Patent No.: US 11,198,574 B2
(45) Date of Patent: Dec. 14, 2021

(54) SHEET DETECTION MECHANISM AND IMAGE FORMING APPARATUS EQUIPPED THEREWITH

(71) Applicant: CANON KABUSHIKI KAISHA, Tokyo (JP)

(72) Inventors: Takafumi Suzuki, Suntou-gun (JP); Yasuhiko Okuma, Suntou-gun (JP); Yusuke Jota, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/383,294

(22) Filed: Apr. 12, 2019

(65) Prior Publication Data

US 2019/0233233 A1 Aug. 1, 2019

Related U.S. Application Data

(63) Continuation of application No. 15/795,951, filed on Oct. 27, 2017, now Pat. No. 10,301,130.

(30) Foreign Application Priority Data

Oct. 31, 2016 (JP) ..... 2016-213530
Jan. 20, 2017 (JP) ..... 2017-008885

(51) Int. Cl.

| | |
|---|---|
| ***B65H 43/08*** | (2006.01) |
| ***B65H 7/02*** | (2006.01) |
| ***G03G 15/20*** | (2006.01) |
| ***B65H 3/66*** | (2006.01) |
| ***B65H 7/14*** | (2006.01) |

(Continued)

(52) U.S. Cl.

CPC ..... *B65H 7/02* (2013.01); *B65H 3/66* (2013.01); *B65H 7/14* (2013.01); *G03G 15/2017* (2013.01); *G03G 15/2028* (2013.01); *G03G 21/206* (2013.01); *B65H 43/08* (2013.01); *B65H 2406/12* (2013.01); *B65H 2406/3662* (2013.01); *B65H 2553/41* (2013.01); *B65H 2601/26* (2013.01); *G03G 15/6511* (2013.01); *G03G 2215/00616* (2013.01); *G03G 2215/00721* (2013.01)

(58) Field of Classification Search

CPC ..... B65H 43/08; B65H 2553/414; B65H 2301/51432

See application file for complete search history.

(56) References Cited

U.S. PATENT DOCUMENTS 4,652,743 A * 3/1987 Harano ..... H04N 1/192 250/227.26
7,018,121 B2 * 3/2006 Barry ..... B41J 11/009 250/239

(Continued)

*Primary Examiner* — Howard J Sanders
(74) *Attorney, Agent, or Firm* — Canon U.S.A., Inc., IP Division

(57) ABSTRACT

According to the present disclosure, a first guide unit is provided with a first opening portion through which light in an optical path connecting a first optical element unit and a second optical element unit passes, a second guide unit is provided with a second opening portion through which light in the optical path connecting the first optical element unit and the second optical element unit passes, the first guide unit is provided with a duct for sending air to the first optical element unit, and the air coming out from the first opening portion hits the second optical element unit via the second opening portion.

10 Claims, 32 Drawing Sheets

(51) Int. Cl.
*G03G 21/20* (2006.01)
*G03G 15/00* (2006.01)

(56) References Cited

U.S. PATENT DOCUMENTS

| | | | | |
|---|---|---|---|---|
| 7,415,219 | B2 * | 8/2008 | Kawamata | G03G 15/6573 399/92 |
| 9,061,850 | B2 * | 6/2015 | Watatani | B65H 7/14 |
| 10,155,635 | B2 * | 12/2018 | Suzuki | G03G 15/5004 |

* cited by examiner

SHEET DETECTION MECHANISM AND IMAGE FORMING APPARATUS EQUIPPED THEREWITH

CROSS REFERENCE TO RELATED APPLICATIONS

The present application is a continuation of U.S. patent application Ser. No. 15/795,951, filed on Oct. 27, 2017, which claims priority from Japanese Patent Application No. 2016-213530, filed Oct. 31, 2016 and Japanese Patent Application No. 2017-008885, filed Jan. 20, 2017, which are hereby incorporated by reference herein in their entireties.

BACKGROUND OF THE INVENTION

Field of the Invention

The present disclosure relates to a sheet detection mechanism to be mounted on an image forming apparatus, such as a printer and a copying machine using an electrophotographic technique and an image forming apparatus equipped therewith.

Description of the Related Art

Image forming apparatuses using an electrophotographic technique are equipped with sheet detection mechanisms for detecting moving sheets and fixing units for heat fixing images on sheets. However, if the sheet detection mechanism exists near the fixing unit, there is a possibility that water vapor generated from a sheet by heat fixing causes dew condensation in the sheet detection mechanism, and the sheet detection mechanism is thermally damaged by radiation heat from the fixing unit.

Japanese Patent Application Laid-Open No. 2007-33520 describes a configuration for cooling a sensor for detecting a sheet by blowing air thereto.

As a type of a sheet detection mechanism for detecting a sheet by illuminating a sheet with light, there is a configuration in which a part of a sensor unit is disposed on both of two guide units disposed to face each other across a sheet conveyance path. For example, a light-emitting unit is arranged on one of the guide units, and a light-receiving unit for receiving light and converting it into an electrical signal is arranged on the other guide unit. When a conveyed sheet blocks the light, presence of the sheet is detected. However, when the sensor unit is cooled by being blown by air in the configuration in which the part of the sensor unit is disposed on both of the two guide units, at least two air ducts are required, and the apparatus becomes larger.

SUMMARY OF THE INVENTION

Thus, the present disclosure is directed to a sheet detection mechanism in which an air blow configuration to a sensor unit is miniaturized and the provision of an image forming apparatus equipped therewith.

A sheet detection mechanism includes a guide unit including a first guide unit and a second guide unit facing the first guide unit across a space in which a sheet moves and configured to guide a sheet, and a sensor unit installed in the guide unit and configured to detect a sheet moving along the guide unit, wherein the sensor unit includes a first optical element unit installed inside of the first guide unit and a second optical element unit installed inside of the second guide unit and configured to optically detect a sheet in cooperation with the first optical element unit, wherein the first guide unit is provided with a first opening portion through which light in an optical path connecting the first optical element unit and the second optical element unit passes, and the second guide unit is provided with a second opening portion through which light in an optical path connecting the first optical element unit and the second optical element unit passes, the first guide unit is provided with a duct for sending air to the first optical element unit, and air coming out from the first opening portion hits the second optical element unit via the second opening portion.

Further features of the present disclosure will become apparent from the following description of exemplary embodiments with reference to the attached drawings.

DESCRIPTION OF THE EMBODIMENTS

Figure 2:
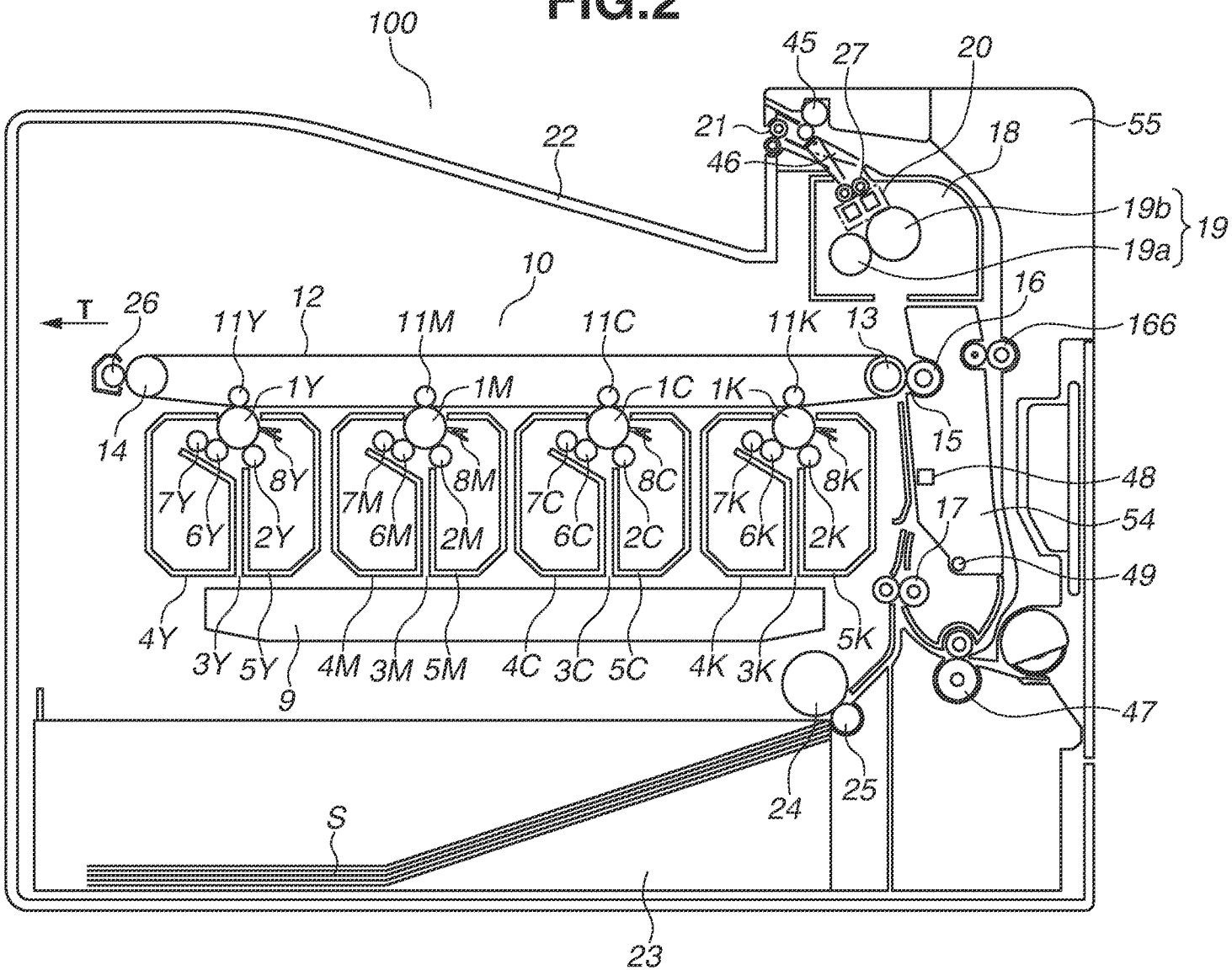
FIG. 2 is a cross-sectional view of an image forming apparatus.

A configuration of an image forming apparatus according to a first exemplary embodiment is described with reference to FIG. 2. FIG. 2 is a cross-sectional view of the image forming apparatus. The image forming apparatus includes an image forming unit, a cleaning unit, a sheet feeding unit, a secondary transfer unit, a fixing unit, a sheet discharge unit, and the like. Each unit is described below with reference to FIG. 2.

(Image Forming Unit)

A main body (printer main body) 100 of the image forming apparatus illustrated in FIG. 2 includes process cartridges 3Y, 3M, 3C, and 3K which are freely detachable to the main body 100. These four process cartridges 3Y, 3M, 3C, and 3K respectively store different colors namely, yellow, magenta, cyan, and black toners. The process cartridges 3Y, 3M, 3C, and 3K are respectively constituted of developing units 4Y, 4M, 4C, and 4K and cleaner units 5Y, 5M, 5C, and 5K. The developing units 4Y, 4M, 4C, and 4K respectively include developing rollers 6Y, 6M, 6C, and 6K, toner applying rollers 7Y, 7M, 7C, and 7K, and toner containers. On the other hand, the cleaner units 5Y, 5M, 5C, and 5K respectively include photosensitive drums 1Y, 1M, 1C, and 1K, charging rollers 2Y, 2M, 2C, and 2K, drum cleaners 8Y, 8M, 8C, and 8K, and waste toner containers. A scanner unit 9 is disposed below the process cartridges 3Y, 3M, 3C, and 3K and scans the photosensitive drums 1Y, 1M, 1C, and 1K with light (a laser beam in the present exemplary embodiment) based on an image signal. The photosensitive drums 1Y, 1M, 1C, and 1K are respectively charged by the charging rollers 2Y, 2M, 2C, and 2K to predetermined potentials and scanned by the scanner unit 9. By the scanning, electrostatic latent images are formed on surfaces of the respective photosensitive drums. These electrostatic latent images are developed by the developing units 4Y, 4M, 4C, and 4K by being supplied with the toners.

A belt unit 10 includes an intermediate transfer belt 12 stretched around a drive roller 13 and a tension roller 14. The tension roller 14 applies a tensile force to the intermediate transfer belt 12 in a direction of an arrow T. Each of the photosensitive drums 1Y, 1M, 1C, and 1K rotates clockwise and the intermediate transfer belt 12 rotates counterclockwise in FIG. 2. Primary transfer rollers 11Y, 11M, 11C, and 11K are disposed inside of the intermediate transfer belt 12 on positions respectively facing the photosensitive drums 1Y, 1M, 1C, and 1K. The primary transfer rollers 11Y, 11M, 11C, and 11K are applied with transfer bias by a bias applying unit, which is not illustrated. By the transfer bias, the toner images are transferred from the photosensitive drum surfaces to the intermediate transfer belt 12, and four color toner images are superimposed with each other on the intermediate transfer belt 12. The toner images are conveyed to a secondary transfer unit 15.

(Cleaning Unit)

After transfer of the toner images, the toners remaining on the photosensitive drums 1Y, 1M, 1C, and 1K are respectively removed by the drum cleaners 8Y, 8M, 8C, and 8K. Further, the toners remaining on the intermediate transfer belt 12 after the secondary transfer to a sheet S are removed by a belt cleaner 26 and collected to a waste toner collecting container, which is not illustrated.

(Sheet Feeding Unit)

The sheet feeding unit is constituted of a sheet feeding roller 24 mounted on the main body 100 and a sheet feeding cassette 23 detachable from the main body 100. The sheet feeding roller 24 rotates by power from a driving unit, which is not illustrated. The sheet S is separated by the sheet feeding roller 24 one by one from the sheet feeding cassette 23 and conveyed to a registration roller pair 17. The registration roller pair 17 finally corrects skew feeding of the sheet S. Further, the registration roller pair 17 matches a timing of scanning the photosensitive drum with a laser beam with a timing of sheet conveyance.

(Secondary Transfer Unit)

The sheet S fed from the sheet feeding unit is conveyed to the secondary transfer unit 15 by the registration roller pair 17. A bias voltage is applied to a secondary transfer roller 16 in the secondary transfer unit 15, and accordingly the four color toner images on the intermediate transfer belt 12 are secondary transferred to the sheet S.

(Fixing Unit)

The sheet S after toner image transfer is conveyed to a fixing unit 18. The toner image on a sheet S surface is heated and fixed to the sheet S at a fixing nip portion N formed between a fixing film 19*a* and a pressure roller 19*b*.

(Sheet Detection Mechanism)

A sheet detection mechanism 20 detects the sheet S nipped and conveyed by the fixing unit 18. The sheet detection mechanism 20 detects the sheet S passing through the fixing nip portion N and transmits detected information to a control unit, which is not illustrated. The control unit performs conveyance control of the sheet S and annunciation of a jam of the sheet S based on the detected information received from the sheet detection mechanism 20. The sheet detection mechanism is installed immediately behind the fixing unit.

(Sheet Discharge Unit)

The sheet S passed through the sheet detection mechanism 20 is conveyed by a roller pair 27. The sheet S passed through the roller pair 27 is conveyed by a sheet discharge roller pair 21 and discharged onto a sheet discharge tray 22. The sheet S according to the present exemplary embodiment is a material which does not transmit light and reflect it on a sheet surface like plain paper.

(Two-Sided Print Sheet Conveyance Mechanism)

As illustrated in FIG. 2, the sheet detection mechanism 20 is disposed immediately behind the fixing film 19*a* and the pressure roller 19*b* in a sheet conveyance direction. A diverter 46 for switching a conveyance destination of the sheet S between the sheet discharge roller pair 21 or a reversing roller pair 45 is disposed downstream of the sheet detection mechanism 20 in the sheet conveyance direction. When two-sided print is executed, the sheet S guided to the reversing roller pair 45 by the diverter 46 is conveyed toward an outside of the apparatus by normal rotation of the reversing roller pair 45. The reversing roller pair 45 rotates reversely before a trailing edge of the sheet S passes through the reversing roller pair 45, so that the trailing edge of the sheet S turns to a leading edge and, the sheet S is conveyed toward a two-sided conveyance roller pair 166. Subsequently, the sheet S is conveyed to the secondary transfer unit 15 by the two-sided conveyance roller pair 166 and a re-feed roller pair 47, and an image is formed on a back surface of the sheet S by the secondary transfer unit 15.

(Detailed Description of Fixing Unit)

Figure 3:
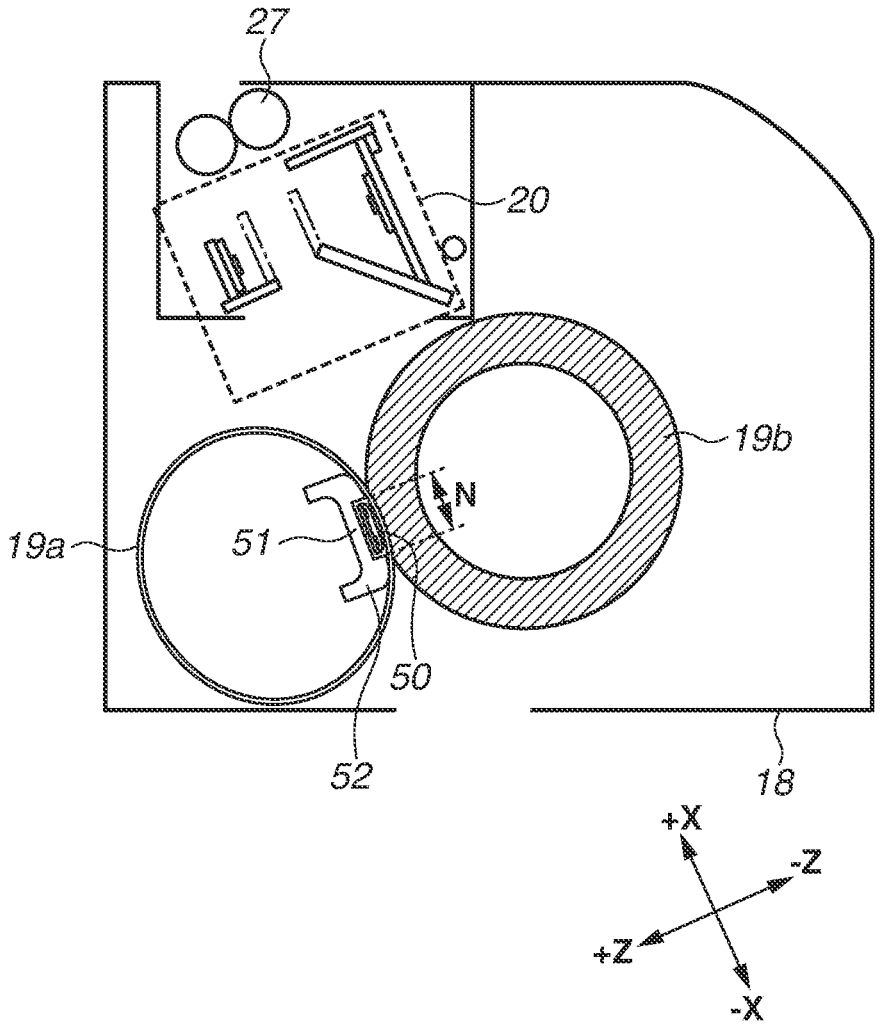
FIG. 3 is a cross-sectional view of a fixing unit according to the first exemplary embodiment.

FIG. 3 is a cross-sectional view of the fixing unit 18. The fixing film 19*a* is a freely rotatable fixing member. A heater 50 abuts on an inner surface of the fixing film 19*a*. A temperature detection unit 51 abuts on a back surface of the heater 50 and detects a temperature of the heater 50. The control unit, not illustrated, controls electricity to be supplied to the heater 50 in response to the temperature detected by the temperature detection unit 51. A film guide 52 regulates a rotational trajectory of the fixing film 19*a*. The heater 50 is held by the film guide 52. The pressure roller 19*b* is a freely rotatable pressure member. The pressure roller 19*b* forms the fixing nip portion N together with the heater 50 via the fixing film 19*a*. The pressure roller 19*b* is driven by a motor, which is not illustrated, and the fixing film 19*a* rotates by following rotation of the pressure roller 19*b*.

Figure 4A:
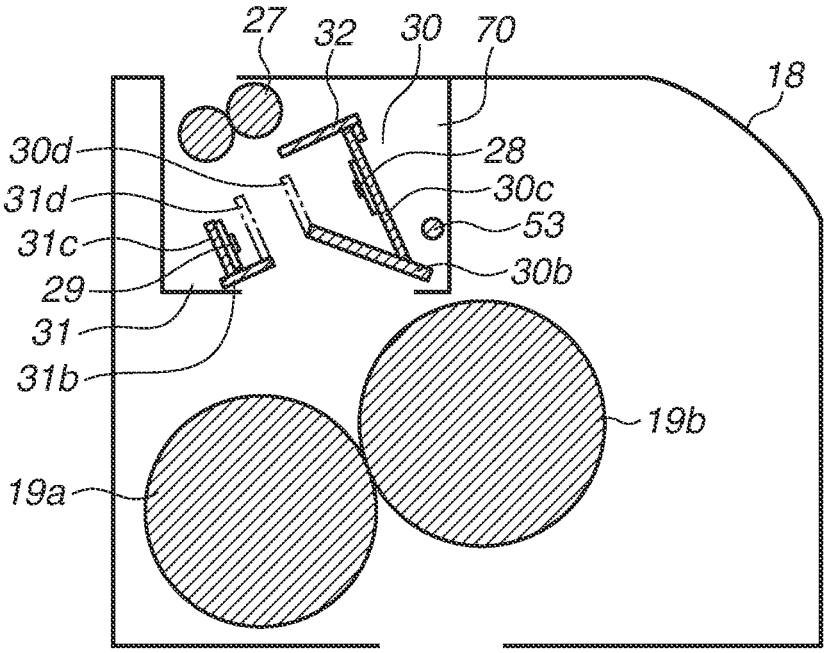
FIGS. 4A and 4B are cross-sectional views of the fixing unit according to the first exemplary embodiment.
Figure 4B:
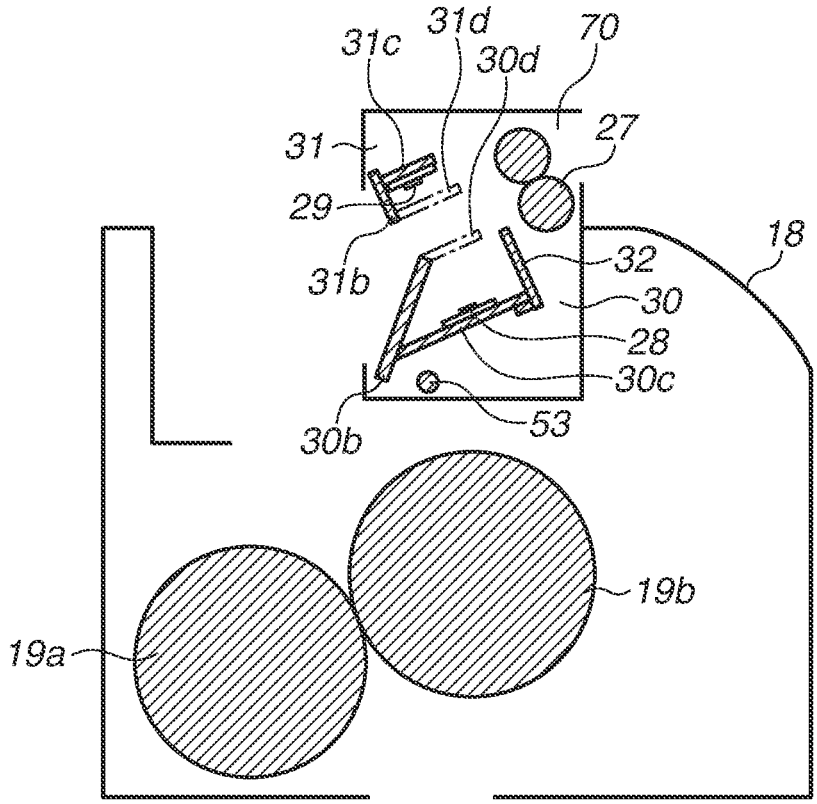

The sheet detection mechanism 20 is disposed on downstream of the fixing nip portion N in the sheet conveyance direction. In addition, the sheet detection mechanism 20 is disposed above the fixing nip portion in a vertical direction. The sheet detection mechanism 20 and the roller pair 27 are unitized as a sheet discharge unit 70. As illustrated in FIGS. 4A and 4B, the sheet discharge unit 70 is mounted on the fixing unit 18 and can rotate centering around a shaft 53 with respect to the fixing unit 18. FIG. 4A illustrates a state at a time of normal printing, and when jam recovery and the like is performed, a user takes out the fixing unit 18 from the printer main body and further rotates the sheet discharge unit 70 to a position illustrated in FIG. 4B, and accordingly, the retained sheet S can be removed.

The fixing film 19*a* has a three layer structure including a base layer, an elastic layer, and a surface layer in the order from an inner side. An outer diameter of the fixing film 19*a* according to the present exemplary embodiment is 24 mm. The base layer is made of polyimide and has a thickness of 70 μm. The elastic layer is made of silicon rubber and has a thickness of 200 μm. The surface layer is made of perfluoroalkyl vinyl ether copolymer (PFA) and has a thickness of 15 μm. The pressure roller 19*b* has a three layer structure including a core metal, an elastic layer, and a release layer in the order from the center. An outer diameter of the pressure roller 19*b* according to the present exemplary embodiment is 25 mm. A material of the core metal is stainless steel (SUS). The elastic layer has a thickness of 4 mm and is made of silicon rubber. The release layer is made of PFA and has a thickness of 30 μm.

The heater 50 has a function of raising a temperature of the fixing film 19*a* to that necessary for fixing the toner on the sheet S thereto. According to the present exemplary embodiment, the heater 50 is a ceramic heater in which a heat generation resistor is printed on a ceramic substrate. In this regard, the heating method is not limited to the above-described one, and a heat roller method and induction heating (IH) method may be adopted.

Figure 5:
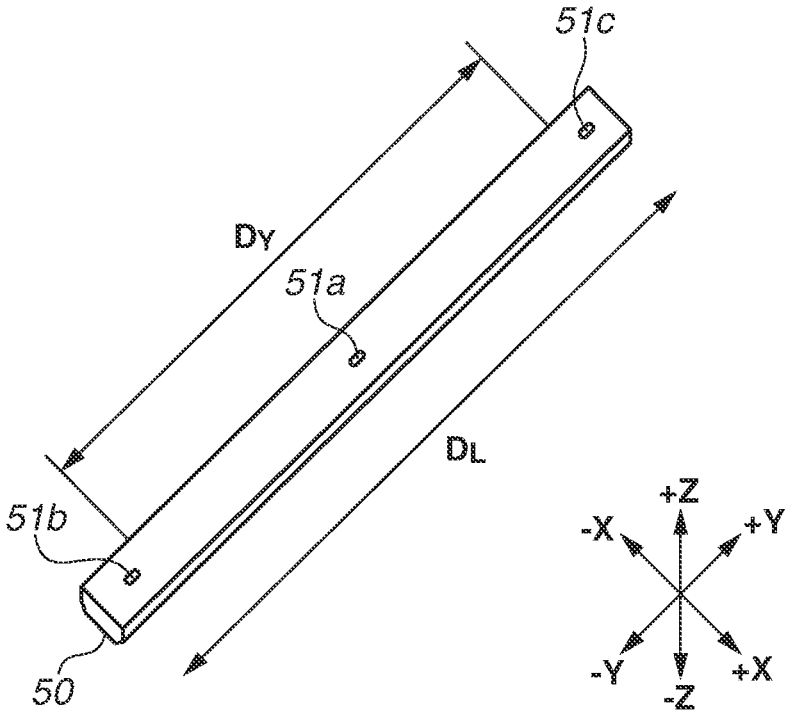
FIG. 5 is a perspective view of a heater and temperature detection units.

FIG. 5 is a perspective view of the heater 50. A +Z side surface in FIG. 5 is a back surface (an opposite surface of a surface brought into contact with the fixing film 19*a*) of the heater 50. An arrow DL direction (a Y-axis direction) in FIG. 5 is defined as a sheet width direction. Three thermistors (temperature detection units) 51*a*, 51*b*, and 51*c* are brought into contact with the heater 50. The temperature detection unit 51*a* is disposed on the center in the sheet width direction of the heater 50. An area where a sheet S having a maximum width which can be used in the printer according to the present exemplary embodiment passes through is defined as an area DY. The temperature detection units 51*b* and 51*c* are disposed on the back surface of the heater 50 at positions on outer side than the area DY in the sheet width direction (the Y-axis direction) and detect temperatures of a non-sheet passing area of the heater. During the fixing processing, the temperature of the non-sheet passing area on the fixing film becomes higher compared to a temperature of a sheet passing area since the temperature of the area is hardly transferred to the sheet S. When a surface temperature of the fixing film 19*a* becomes too high, the surface layer of the fixing film 19*a* may melt, thus it is necessary to control the printer so that the surface temperature of the fixing film 19*a* does not exceed a predetermined threshold temperature. When at least one of temperatures detected by the temperature detection units 51*b* and 51*c* exceeds the predetermined threshold temperature, a sheet passing interval during continuous printing is prolonged, and the fixing film 19*a* is driven to rotate until the detected temperatures of both of the temperature detection units 51*b* and 51*c* drop below the threshold temperature. The surface temperature of the fixing film 19*a* is prevented from exceeding the predetermined threshold temperature by the above-described control.

(Description of Basic Configuration of Sheet Detection Mechanism)

Figure 6A:
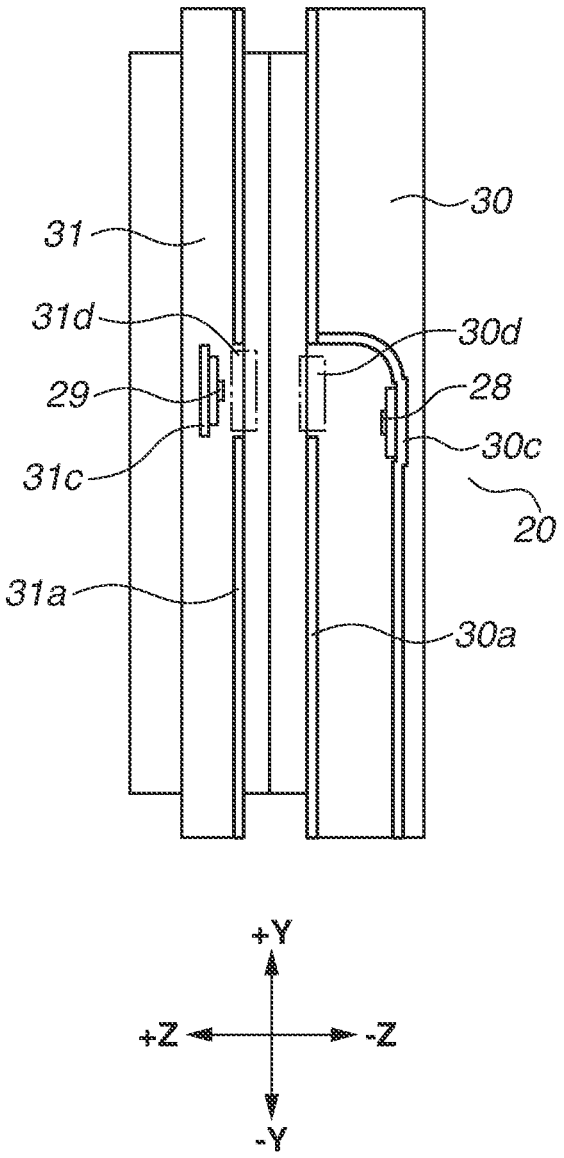
FIGS. 6A and 6B are a top view and a cross-sectional view of the sheet detection mechanism according to the first exemplary embodiment.
Figure 6B:
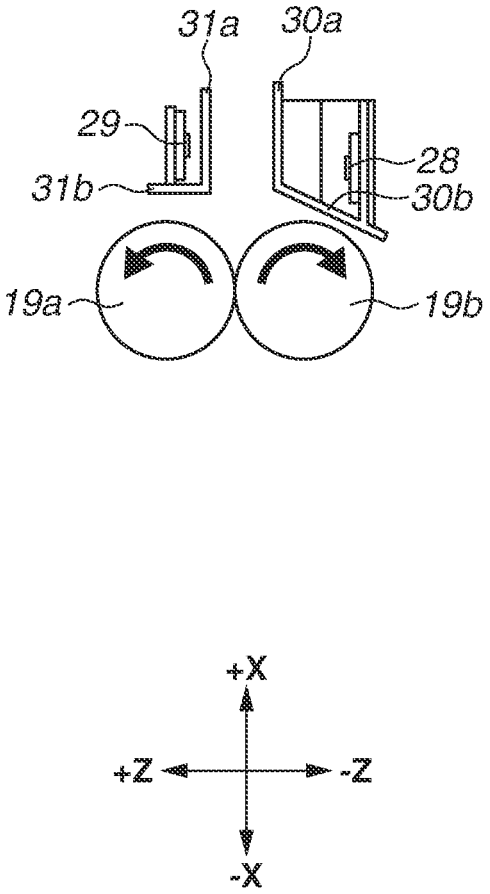

A basic configuration of the sheet detection mechanism 20 according to the present exemplary embodiment is described. FIG. 6A is a top view and FIG. 6B is a side view of the sheet detection mechanism 20 according to the present exemplary embodiment. The sheet detection mechanism 20 includes guide units (30 and 31) for guiding the sheet S and sensor units (28 and 29) for detecting the sheet S moving along the guide units (30 and 31).

The guide units (30 and 31) includes a first guide unit 30 and a second guide unit 31 facing the first guide unit 30 across a space in which the sheet S moves. The first guide unit 30 faces a non-printing surface of the sheet S in the case of one-side print, and the second guide unit 31 faces a printing surface of the sheet S in the case of the one-side print. The first guide unit 30 includes a sheet passing portion 30*a* and a bottom surface portion 30*b*. The second guide unit 31 includes a sheet passing portion 31*a* and a bottom surface portion 31*b*. The sheet S to be conveyed passes through a sheet conveyance path (the space in which the sheet moves) formed between the sheet passing portion 30*a* of the first guide unit 30 and the sheet passing portion 31*a* of the second guide unit 31 and is discharged.

The sensor units (28 and 29) include a first optical element unit 28 which is disposed inside of the first guide unit 30 and a second optical element unit 29 which is disposed inside of the second guide unit 31 and optically detects the sheet S in cooperation with the first optical element unit 28. In the apparatus according to the present exemplary embodiment, the first optical element unit 28 is a light-emitting unit, and the second optical element unit 29 is a light-receiving unit. The light-emitting unit 28 is formed by attaching a light emitting element on an electrical substrate. The light-receiving unit 29 is formed by attaching a light receiving element on an electrical substrate. The light-receiving unit 29 has a function of receiving light and converting the received light into an electrical signal.

The light-emitting unit 28 is fixed to a sensor fixing portion 30*c* of the first guide unit 30. The light-receiving unit 29 is fixed to a sensor fixing portion 31*c* of the second guide unit 31. The sheet passing portion 30*a* of the first guide unit 30 has a first opening portion 30*d* through which light in an optical path connecting the light-emitting unit 28 and the light-receiving unit 29 passes. The sheet passing portion 31*a* of the second guide unit 31 has a second opening portion 31*d* through which the light in the optical path connecting the light-emitting unit 28 and the light-receiving unit 29 passes.

It is desirable to use a light emitting diode (LED) which consumes little power and emits electroluminescence for the light-emitting unit 28. In addition, when the LED is used, an arrangement space can be further saved by adopting a surface mounted type LED rather than a shell type one. The above-described arrangement of the light-emitting unit 28 and the light-receiving unit 29 may be in reverse order.

(Description of Operation of Sheet Detection Mechanism)

Figure 7A:
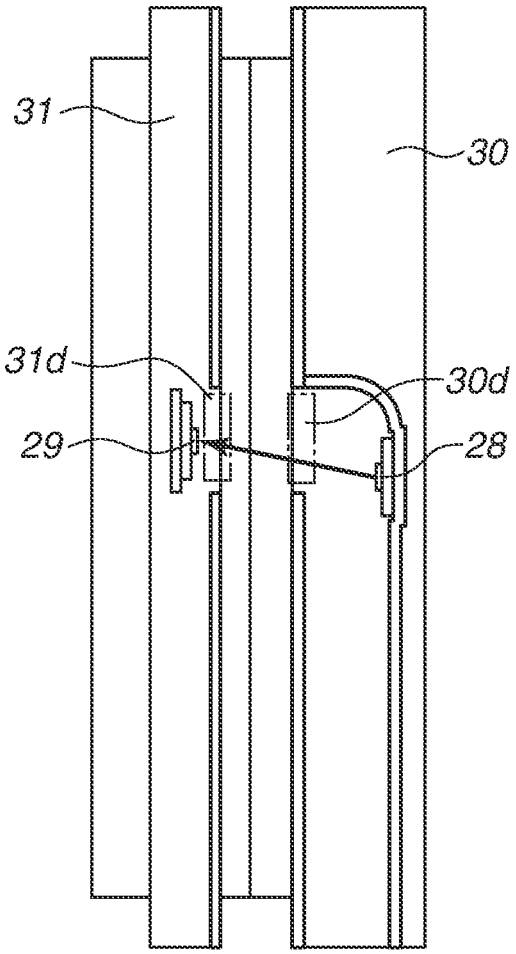
FIGS. 7A and 7B are a top view and a cross-sectional view of the sheet detection mechanism (at a timing before detecting a sheet) according to the first exemplary embodiment.
Figure 7B:
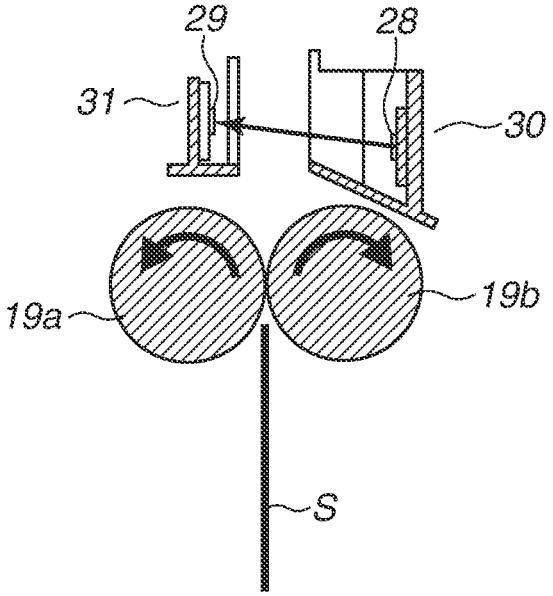

Operations of the sheet detection mechanism 20 according to the present exemplary embodiment are described. First, FIGS. 7A and 7B illustrate a state in which the sheet detection mechanism 20 does not detect the sheet S. FIG. 7A is a cross-sectional view of the sheet detection mechanism 20 at a position where the sensor unit exists in an X-axis direction (see FIG. 6A). FIG. 7B is a cross-sectional view of the sheet detection mechanism 20 at a position where the sensor unit exists in the Y-axis direction (see FIG. 6B). As illustrated in FIGS. 7A and 7B, in a state in which the sheet S does not exist in the optical path of the sensor unit, light from the light-emitting unit 28 passes through the first opening portion 30*d*, the sheet conveyance path, and the second opening portion 31*d* and reaches the light-receiving unit 29, and an electric current flows in the light-receiving unit 29. Thus, a state in which an electric current flows in the light-receiving unit 29 is a state in which the sheet S is not detected.

Figure 8A:
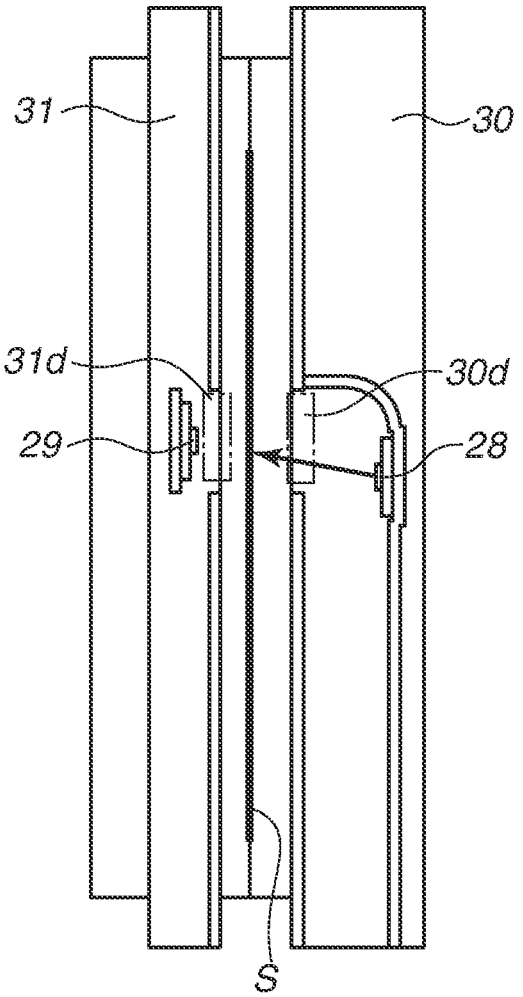
FIGS. 8A and 8B are a top view and a cross-sectional view of the sheet detection mechanism (at a timing when detecting a sheet) according to the first exemplary embodiment.
Figure 8B:
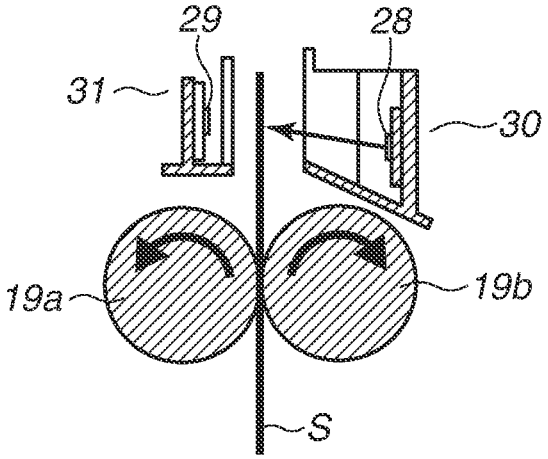

Next, FIGS. 8A and 8B illustrate a state in which the sheet detection mechanism 20 detects the sheet S. As illustrated in FIGS. 8A and 8B, in a state in which the sheet S exists in the optical path of the sensor unit, the light from the light-emitting unit 28 advances to the sheet S surface through the first opening portion 30*d* and is blocked on the sheet S surface. Accordingly, the light does not reach the light-receiving unit 29, and an electric current does not flow. Thus, a state in which an electric current does not flow in the light-receiving unit 29 is a state in which the sheet S is detected.

As described above, the sheet detection mechanism 20 is disposed immediately behind the fixing film 19*a* and the pressure roller 19*b* in the sheet conveyance direction. The sheet detection mechanism 20 has a configuration in which a state in which the light emitted from the light-emitting unit 28 is blocked by the sheet S and does not reach the light-receiving unit 29 is regarded as a sheet existing state (a state in which a sheet is detected). This configuration can eliminate sliding damage on the sheet S caused by a conveyance guide near the sheet detection mechanism 20 and accurately switch the diverter 46 when the sheet S is conveyed at a higher speed. The reason is described below.

Recently, there is a tendency to miniaturize an apparatus by suppressing a height of the apparatus. When a low height apparatus is designed, a curvature of a conveyance path after passing the fixing unit is forced to be large in many cases. At the same time, productivity improvement in two-sided printing (high-speed printing) is also demanded.

A conveyance path having a large curvature becomes a factor causing sliding damage on an image. On the other hand, high-speed printing requires increase of precision in operations at switching timing of the diverter 46 which operates when the sheet detection mechanism detects an edge portion of the sheet S.

In order to prevent damage on an image, it is necessary to increase a width of the sheet conveyance path (a distance in a vertical direction with respect to the sheet S surface) provided from the fixing film 19*a* and the pressure roller 19*b* to the diverter 46 so that the sheet S does not actively abut on the conveyance guide. However, when the width of the sheet conveyance path is increased, an orientation of the sheet S passing through the sheet conveyance path is unstable. Especially, the orientation is greatly affected by a degree of curl of the sheet S. Thus, it is difficult to accurately detect the edge portion of the sheet S.

Therefore, when the sheet detection mechanism 20 which detects the sheet S when the sheet S blocks the light from the light-emitting unit 28 is adopted as in the present exemplary embodiment, the edge portion of the sheet S can be accurately detected. For example, in the case of a sheet detection mechanism which detects the sheet S by reflecting the light from the light-emitting unit 28 on the sheet S surface, there is a possibility that detection accuracy varies depending on an orientation of the sheet S, however, the sheet detection mechanism 20 according to the present exemplary embodiment can suppress such a possibility.

(Description of Air Blowing Configuration)

Next, an air blow configuration in the sheet detection mechanism 20 is described. When the sheet (plain paper) S which adsorbed moisture passes through the fixing nip portion N and is subjected to heating and fixing processing, the sheet S generates high temperature water vapor. The sheet detection mechanism 20 is disposed above the fixing nip portion N in the vertical direction, the generated the water vapor reaches the sheet detection mechanism 20 by natural convection. When the water vapor enters from the opening portions 30*d* and 31*d* of the sheet detection mechanism 20 and reaches the light-emitting unit 28 and the light-receiving unit 29, dew condensation may occur, and the apparatus may malfunction. In addition, when the light-emitting unit 28 and the light-receiving unit 29 become high temperature by heat transfer from the fixing unit 18 to the sheet detection mechanism 20, these units may malfunction. Therefore, an air blow configuration is required to prevent dew condensation in the light-emitting unit 28 and the light-receiving unit 29 and temperature rise of these elements.

Figure 9A:
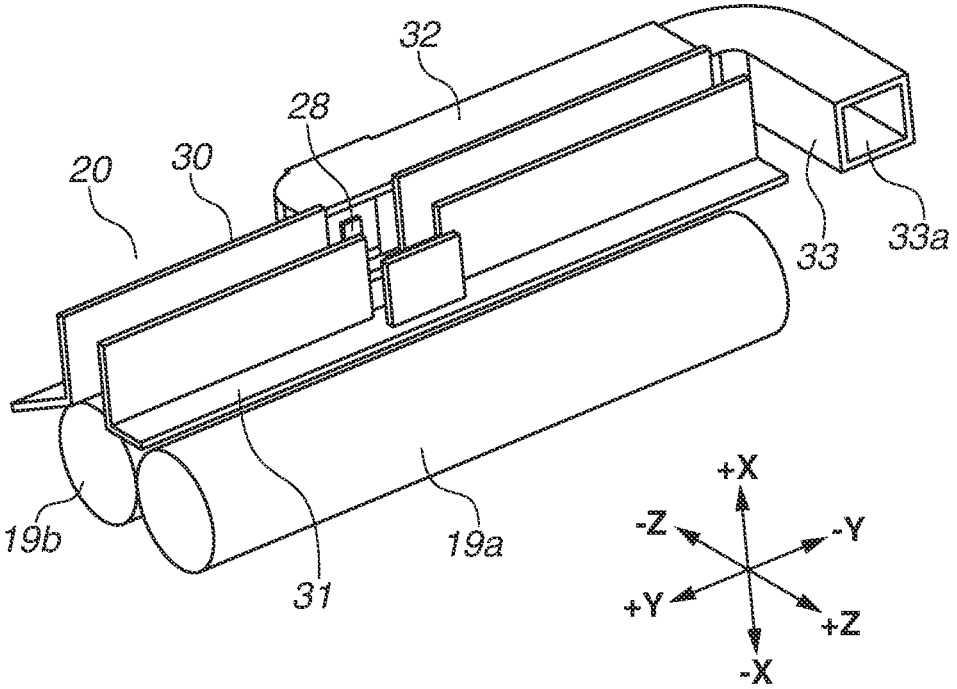
FIGS. 9A and 9B are perspective views of the sheet detection mechanism according to the first exemplary embodiment.
Figure 9B:
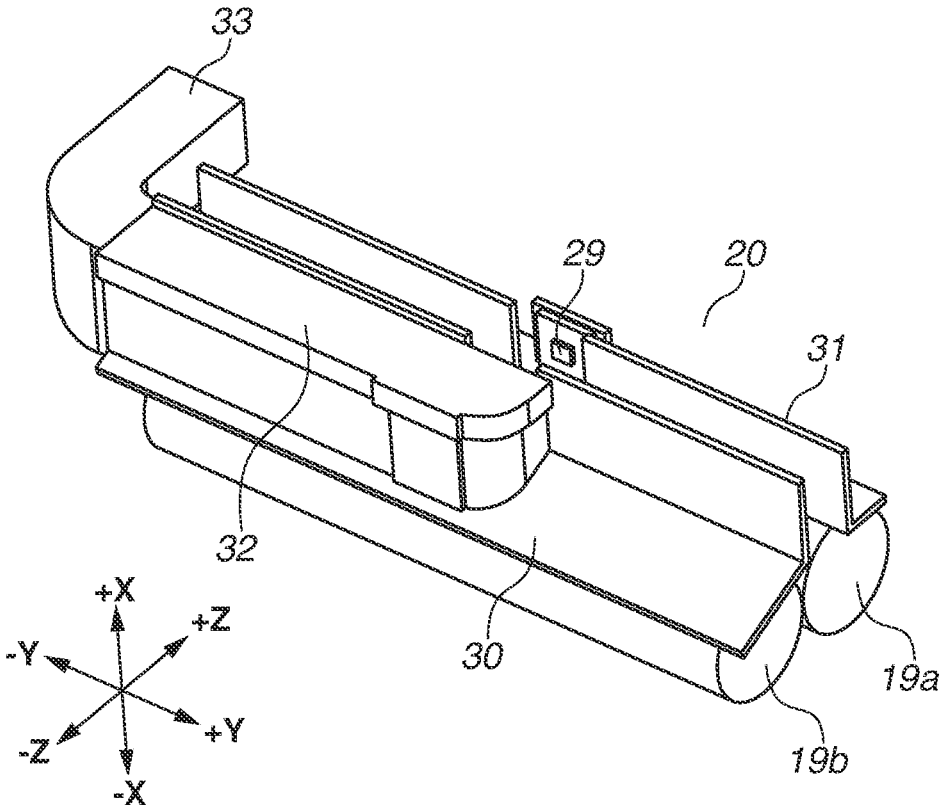
Figure 10:
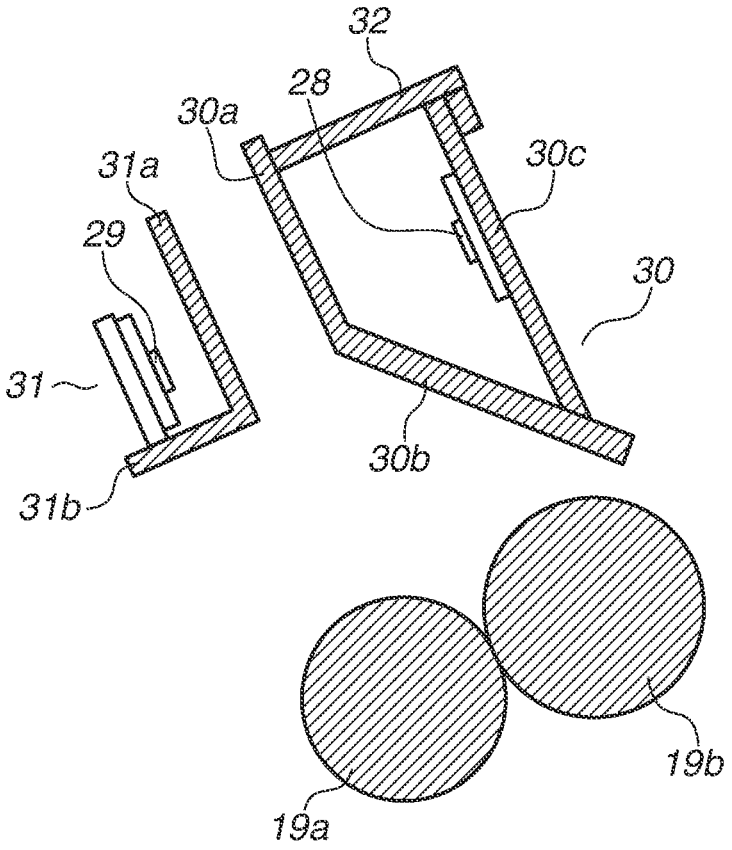
FIG. 10 is a cross-sectional view of an air duct in the sheet detection mechanism according to the first exemplary embodiment.

FIGS. 9A and 9B are perspective views of the air blow configuration according to the sheet detection mechanism 20. FIG. 9A is the perspective view of the sheet detection mechanism 20 viewing the light-emitting unit 28 side from the light-receiving unit 29 side. FIG. 9B is the perspective view of the sheet detection mechanism 20 viewing the light-receiving unit 29 side from the light-emitting unit 28 side. FIG. 10 is a cross-sectional view of the sheet detection mechanism 20.

A lid member 32 is attached to the first guide unit 30 so as to cover the light-emitting unit 28, and the first guide unit 30 and the lid member 32 form a duct. In addition, a duct member 33 is attached to an edge portion in a −Y direction of the lid member 32. The duct member 33 has a hollow structure and can send air to the duct formed by the first guide unit 30 and the lid member 32 as illustrated in FIG. 10.

Figure 1:
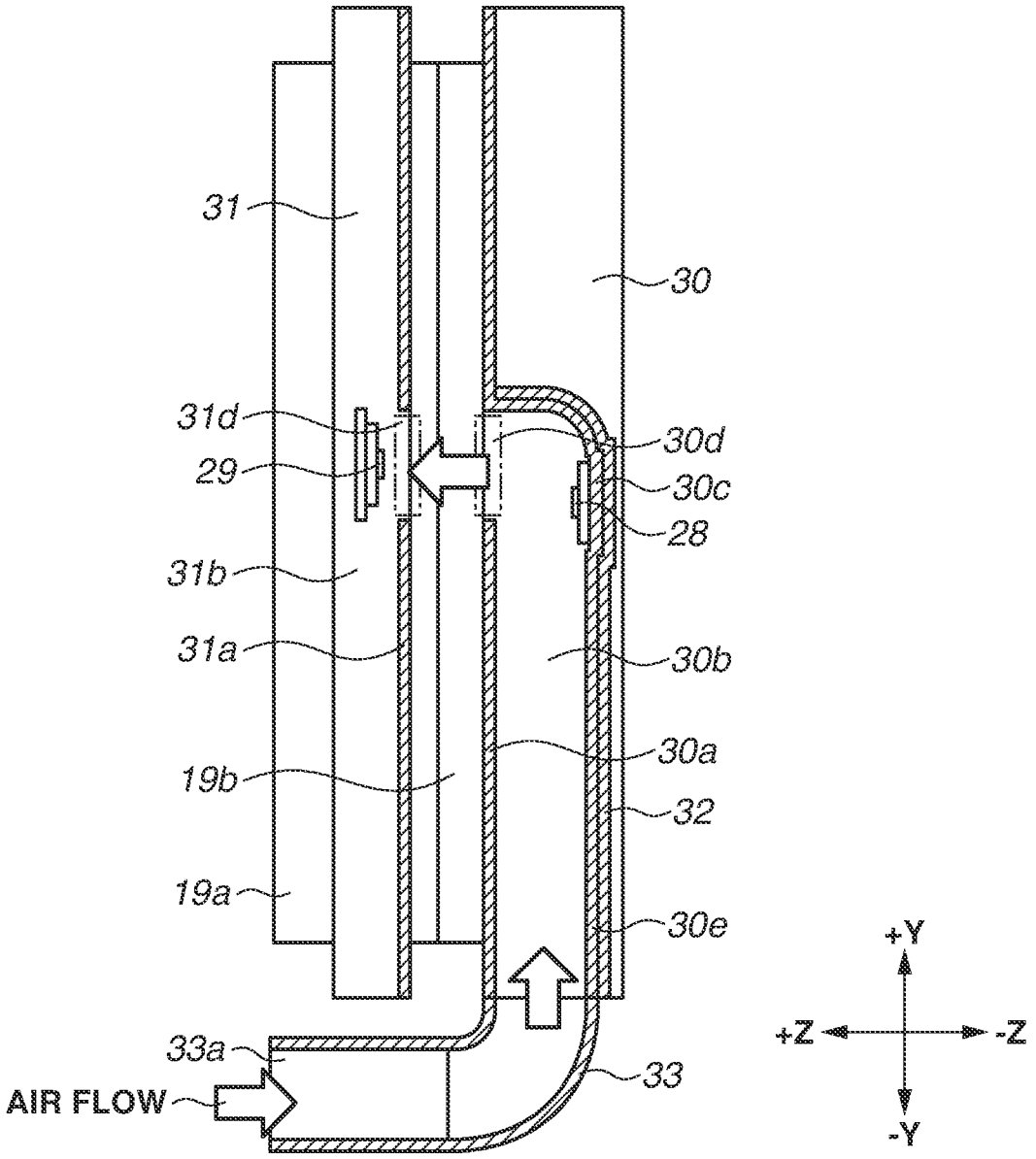
FIG. 1 is a cross-sectional view of a sheet detection mechanism according to a first exemplary embodiment.

Next, FIG. 1 is a cross-sectional view of the air blow configuration in the sheet detection mechanism 20. First, there is a guide portion 33*a* for taking in air sent from the image forming apparatus main body 100. The air duct is bent at a right angle from the guide portion 33*a* toward the first guide unit 30. Thus, a corner is formed in a curve so as to efficiently send the air. In addition, an exhaust guide 30*e* for guiding air is formed inside the first guide unit 30. The light-emitting unit 28 is arranged in the air duct (a duct) formed by the exhaust guide 30*e*. Further, the exhaust guide 30*e* and the light-emitting unit 28 are set to eliminate a level difference therebetween as much as possible in order to efficiently send the air. In addition, the air duct is bent at a right angle from the first guide unit 30 to the opening portion 30*d* of the first guide unit 30 as with the duct member 33, so that the exhaust guide 30*e* from the light-emitting unit 28 to the opening portion 30*d* of the first guide unit 30 is formed in a curve. Thus, the duct is formed by the sheet passing portion 30*a*, the bottom surface portion 30*b*, and the exhaust guide 30*e* of the first guide unit 30 and the lid member 32.

(Description of Air Flow)

An air flow in the air blow configuration in the sheet detection mechanism according to the present exemplary embodiment is described with reference to FIG. 1. First, air is blown from a fan, which is not illustrated, disposed inside the image forming apparatus main body 100. Next, the blown air is taken into the guide portion 33*a* of the duct member 33. The air blow is sent to the air duct which is bent at a right angle from the guide portion 33*a* and formed by the sheet passing portion 30*a*, the bottom surface portion 30*b*, and the exhaust guide 30*e* of the first guide unit 30 and the lid member 32. The air blow is bent at a right angle by the air duct from the light-emitting unit 28 toward the opening portion 30*d* of the first guide unit 30. The bent air is sent from the opening portion 30*d* of the first guide unit 30 to the opening portion 31*d* of the second guide unit 31 across the sheet conveyance path. Finally, the air entering from the opening portion 31*d* of the second guide unit 31 is blown onto the light-receiving unit 29. Since the air is blown onto the second optical element unit (the light-receiving unit 29) on a side on which the duct is not installed via the opening portions 30*d* and 31*d*, dew condensation in the first and second optical element units can be suppressed. In addition, these optical element units can be suppressed from becoming high temperature.

As described above, in the case that the duct is installed only one of two guide units, air can be sent to the optical element units respectively disposed on both of the two guide units. Accordingly, the image forming apparatus can be miniaturized while preventing dew condensation in the sheet detection mechanism 20 and malfunction of the sensor caused by a heat source. According to the present exemplary embodiment, the optical path and the air duct from the light-emitting unit 28 to the light-receiving unit 29 are formed in the same route, however, the optical path and the air duct may be in different routes. In addition, the light-emitting unit and the light-receiving unit may be arranged in reverse order with each other.

Further, according to the configuration of the present exemplary embodiment, an optical path length and an air duct length are respectively the shortest lengths, and following effects can be achieved. More specifically, a light emission amount of the light-emitting unit can be reduced as the optical path length is shorter, and thus effects of saving power and extending life of the light-emitting unit can be achieved. Further, an air blow amount of the fan can be reduced as the air duct length is shorter, and thus effects of miniaturization and power saving of the fan can be achieved. Furthermore, an air amount to be blown to the sheet conveyance path can be reduced as the air duct length is shorter, and thus it can prevent an adverse effect on an image which is caused by locally cooling the fixing nip portion.

Next, a second exemplary embodiment is described with reference to FIGS. 11 to 16. The same components and components having the same functions as those of the first exemplary embodiment are denoted by the same reference numerals, and descriptions thereof are omitted. In a sheet detection mechanism according to the present exemplary embodiment, a first optical element unit includes a light-emitting unit and a light-receiving unit, and a second optical element unit includes a reflection member for reflecting light from the light-emitting unit of the first optical element unit to the light-receiving unit.

(Description of Basic Configuration and Operation of Sheet Detection Mechanism)

Figure 11A:
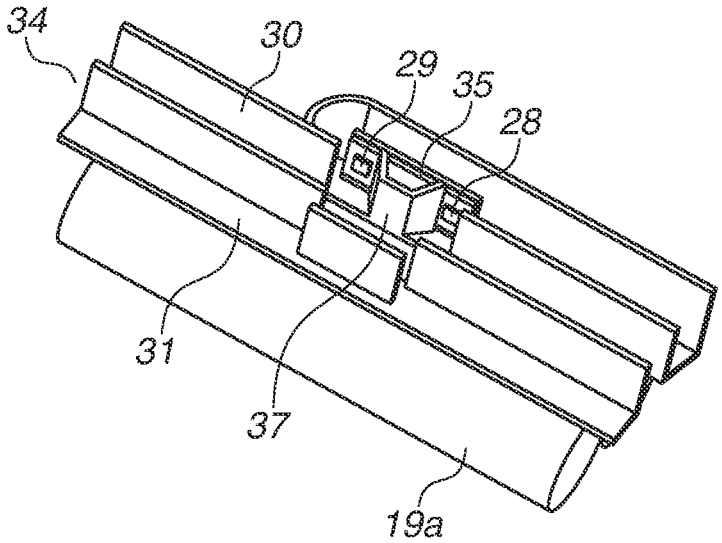
FIGS. 11A and 11B are perspective views of a sheet detection mechanism according to a second exemplary embodiment.
Figure 11B:
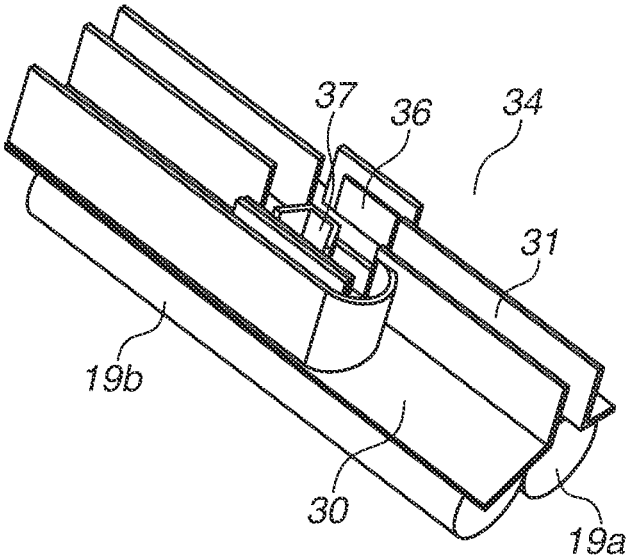

FIG. 11A is a perspective view of a sheet detection mechanism 34 viewing the light-receiving unit 29 side from a reflection member 36 side. FIG. 11B is a perspective view of the sheet detection mechanism 34 viewing the reflection member 36 side from the light-receiving unit 29 side. Performance of the light-emitting unit 28 and the light-receiving unit 29 has temperature dependence. For example, an LED serving as the light-emitting unit 28 has temperature dependence of life. Further, a phototransistor serving as the light-receiving unit 29 has temperature dependence of a quantity of dark current which flows even when light is not received. From these viewpoints, it is desirable that both of the light-emitting unit 28 and the light-receiving unit 29 have configurations which are not affected by a heat source. However, when the sheet detection mechanism 34 is disposed near the fixing nip portion, electrical components thereof are inevitably disposed near the heat source. Thus, according to the present exemplary embodiment, the electrical components are arranged away from the heat source as far as possible.

Figure 12A:
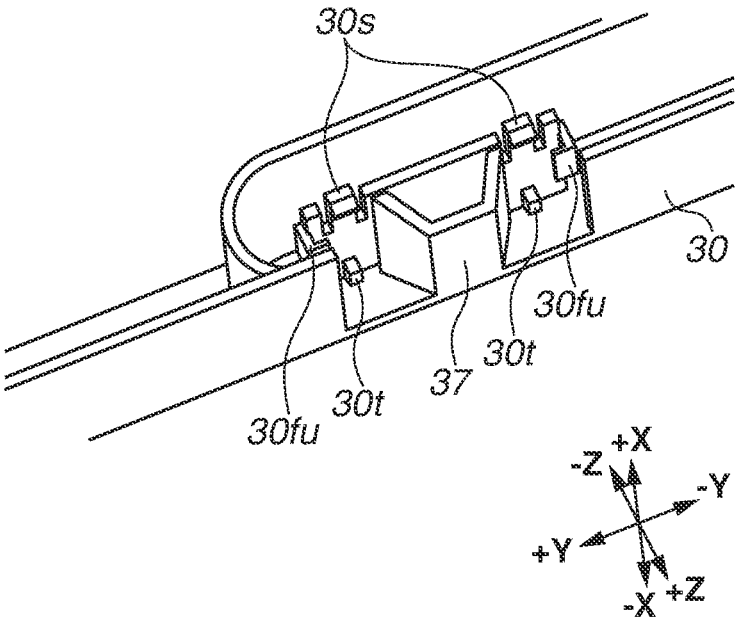
FIGS. 12A and 12B are perspective views of the sheet detection mechanism according to the second exemplary embodiment.
Figure 12B:
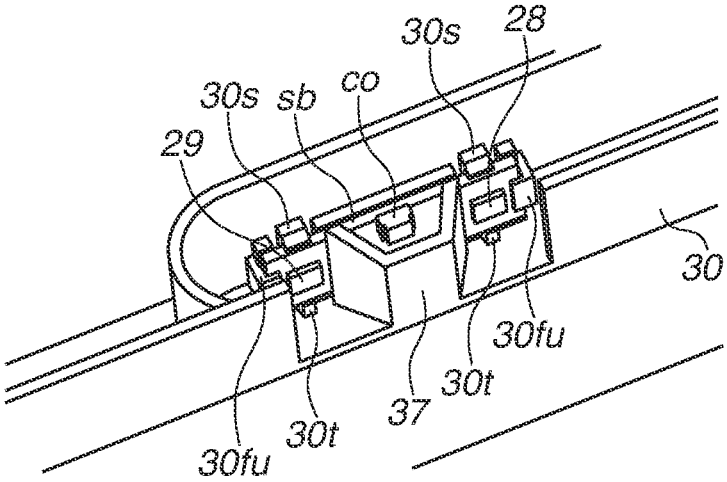
Figure 13A:
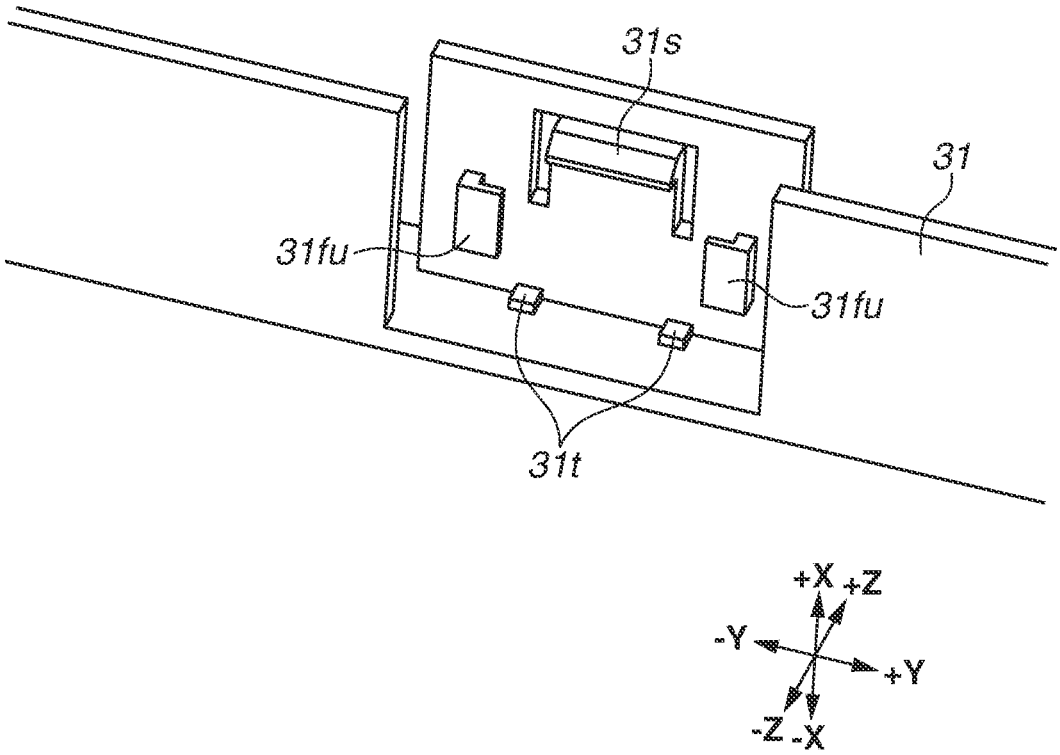
FIGS. 13A and 13B are perspective views of the sheet detection mechanism according to the second exemplary embodiment.
Figure 13B:
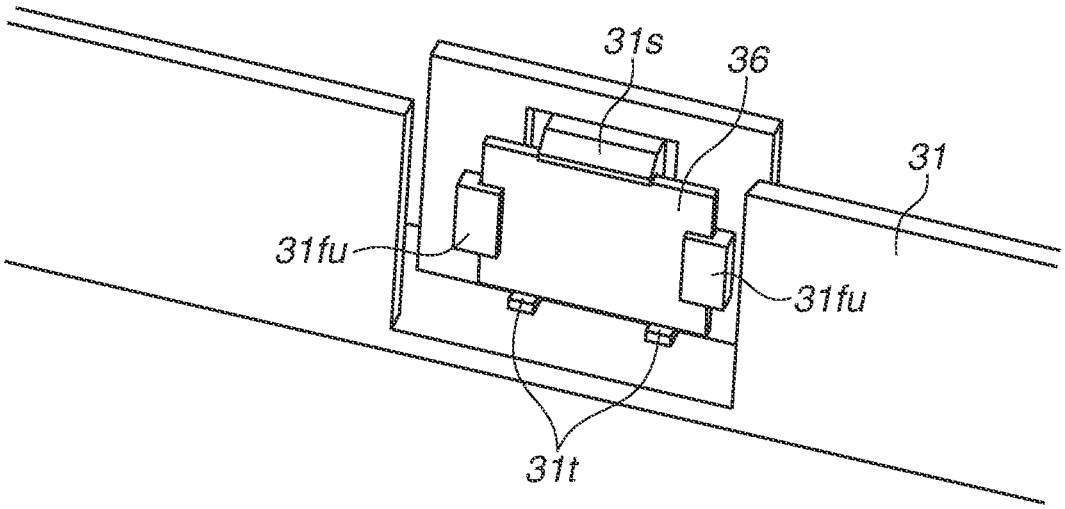

FIG. 12A illustrates a state before a substrate sb on which the light-emitting unit 28 and the light-receiving unit 29 are mounted is attached to the first guide unit 30. The substrate sb abuts on an abutting portion 30*t*, a hook 30*fu* holds the substrate sb, and a snap portion 30*s* for fixing the substrate sb can be elastically deformed. These members are integrally molded with the first guide unit 30. FIG. 12B illustrates a state in which the substrate sb on which the light-emitting unit 28 and the light-receiving unit 29 are mounted is attached to the first guide unit 30. The substrate sb is provided with a connector co for connecting an electric cable. Similarly, FIG. 13A illustrates a state before a reflection member (mirror) 36 is attached to the second guide unit 31. The reflection member 36 abuts on an abutting portion 31*t*, a hook 31*fu* holds the reflection member 36, and a snap portion 31*s* for fixing the reflection member 36 can be elastically deformed. These members are integrally molded with the second guide unit 31. FIG. 13B illustrates a state in which the reflection member 36 is attached to the second guide unit 31.

The light-emitting unit 28 and the light-receiving unit 29 are mounted on the first guide unit 30 disposed above the pressure roller 19*b*. Further, the light-emitting unit 28 and the light-receiving unit 29 are mounted on a single substrate 35 so as to improve assemblability. The reflection member 36 for reflecting the light from the light-emitting unit 28 is disposed on the second guide unit 31 disposed above the fixing film 19*a*.

The pressure roller 19*b* does not have a heat source like a heater, so that the electrical components like the light-emitting unit 28 and the light-receiving unit 29 are less likely to be thermally damaged by being disposed above the pressure roller 19*b* than by being disposed above the fixing film 19*a* including the heat source therein. The reflection member 36 is not an electrical component and less likely to be thermally damaged than the light-emitting unit 28 and the light-receiving unit 29.

In addition, a sheet S is detected when the sheet S blocks the light from the light-emitting unit 28 as similar to the first exemplary embodiment, and an edge portion of the sheet S can be accurately detected as described according to the first exemplary embodiment. Further, according to the present exemplary embodiment, a glossy sheet metal is used as the reflection member 36. An aluminum deposited polyethylene terephthalate (PET) sheet and a mirror of which a glass surface is vapor deposited with aluminum or silver may be used as the reflection member 36, however, a sheet metal is desirable in consideration of output stability of the light-receiving unit 29. Especially, stainless steels are desirable, and SUS430 is the most desirable therein. According to the present exemplary embodiment, a stainless steel (SUS430 (thickness t=0.4 mm)) is used as a sheet metal. As a surface finish code of stainless steel, surface finish 2B is used. There are following three reasons why a sheet metal, especially a stainless steel (SUS430) is desirable.

The first reason is that a stable output can be obtained even if an ambient temperature changes a lot. If a mounting portion of the reflection member 36 integrally molded with the second guide unit 31 is deformed by thermal expansion, a surface of the reflection member is hardly deformed by rigidity of the reflection member 36 itself. Thus, a position accuracy of the reflection member is stabilized with respect to the light-emitting unit 28 and the light-receiving unit 29, a light amount illuminating the light-receiving unit 29 is stabilized, and accordingly output of the light-receiving unit 29 is stabilized.

The second reason is that when a stainless steel is used as a sheet metal, the stainless steel is resistant to surface corrosion in a high humidity environment. In the fixing unit, the sheet S is heated and generates water vapor. Thus, stainless steels which are resistant to corrosion in a high humidity environment are suitable. A plated sheet metal may be used, however, if the surface of the reflection member 36 is damaged during assembly or use, the sheet metal may be easily corroded therefrom, thus a material which is resistant to corrosion by single unit as a stainless steel is suitable. As main types of stainless steels, there are SUS304 including chromium and nickel and SUS430 including chromium. SUS304 has higher corrosion resistance than SUS430, however, only water vapor is generated the most in the image forming apparatus, thus SUS430 may be used.

The third reason is that SUS430 can inexpensively obtain glossy surface compared to SUS304. As described above, SUS304 includes nickel and thus is more expensive than SUS430. In addition, SUS304 has higher corrosion resistance and causes irregularity on its surface in acid pickling for surface finishing compared to SUS430. Glossiness is lost by the irregularity. Thus, SUS430 can increase a light amount to be reflected to the light-receiving unit 29.

Figure 14:
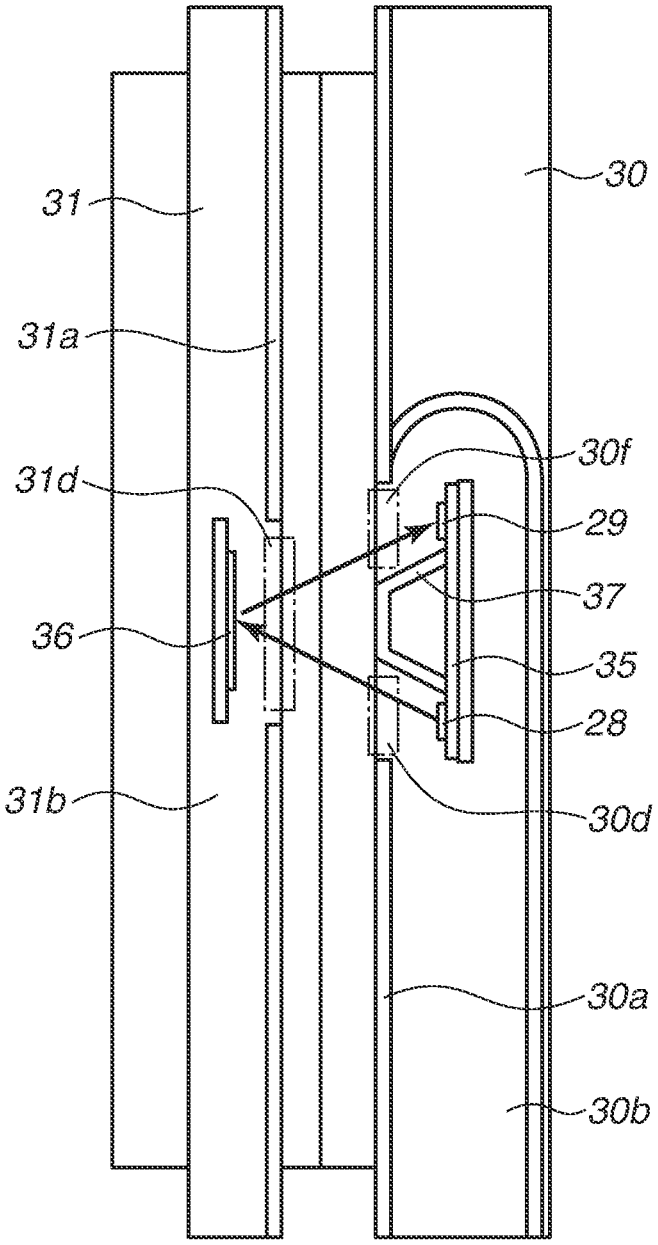
FIG. 14 is a cross-sectional view of the sheet detection mechanism (at a timing before detecting a sheet) according to the second exemplary embodiment.

Next, a sheet detection operation is described. FIG. 14 illustrates a state in which the sheet detection mechanism 34 does not detect the sheet S. FIG. 14 is a top view of the sheet detection mechanism 34. A light-blocking rib (a light-blocking unit) 37 is disposed between the light-emitting unit 28 and the light-receiving unit 29 and prevents the light from the light-emitting unit 28 from directly reaching the light-receiving unit 29. Further, the light-blocking rib 37 extends to the sheet passing portion 30*a* of the first guide unit 30, and thus the opening portion is divided into two parts. More specifically, the first opening portion provided in the first guide unit 30 is divided into an opening portion 30*d* corresponding to the light-emitting unit 28 and an opening portion 30*f* corresponding to the light-receiving unit 29. In such configuration, the light from the light-emitting unit 28 enters from the opening portion 30*d* of the first guide unit 30 to the opening portion 31*d* of the second guide unit 31 across the sheet conveyance path and reaches the reflection member 36. The illuminating light is reflected on the surface of the reflection member 36, enters from the opening portion 31*d* of the second guide unit 31 to the opening portion 30*f* of the first guide unit 30 across the sheet conveyance path and reaches the light-receiving unit 29. Accordingly, an electric current flows in the light-receiving unit 29, and the sheet detection mechanism 34 becomes a state in which the sheet S is not detected.

Figure 15:
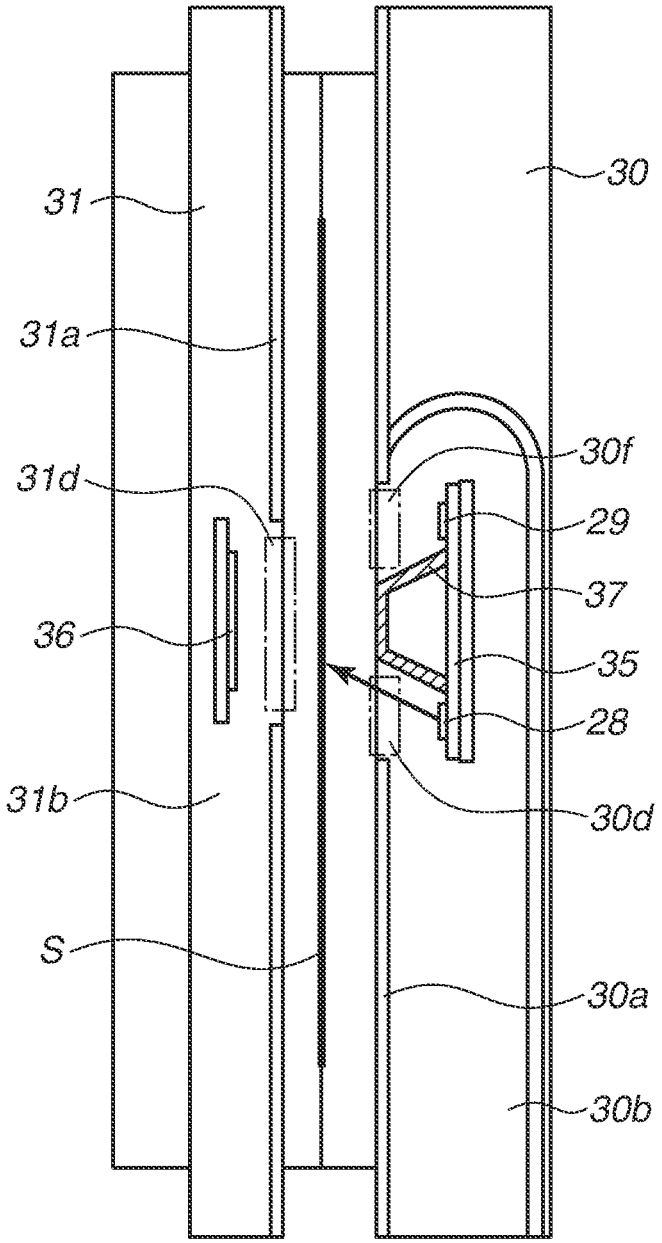
FIG. 15 is a cross-sectional view of the sheet detection mechanism (at a timing when detecting a sheet) according to the second exemplary embodiment.

FIG. 15 illustrates a state in which the sheet detection mechanism 34 detects the sheet S. The light from the light-emitting unit 28 reaches to the sheet S surface from the opening portion 30*d* of the first guide unit 30. The light is blocked by the sheet S surface and does not reach to the light-receiving unit 29. Accordingly, an electric current does not flow in the light-receiving unit 29, and the sheet detection mechanism 34 becomes a state in which the sheet S is detected.

The sheet detection mechanism may have a configuration for reflecting the light from the light-emitting unit 28 twice inside of the reflection member 36. A specific example of such a reflection member 36 is a U-shaped prism. However, as the number of reflections is larger, a deviation of a reflection angle becomes larger, and reliability of the sheet detection mechanism may be impaired. Therefore, the configuration in which the light is reflected once by the reflection member 36 is desirable as in the present exemplary embodiment. Further, as described above, in the configuration for reflecting twice, the reflection member 36 is required to have a thickness in a light advancing direction like a U-shaped prism, however, in the configuration for reflecting once, the reflection member 36 can have a plate shape, and the apparatus can be miniaturized.

(Description of Air Blowing Configuration and Air Flow)

The sheet detection mechanism 34 using the reflection member according to the present exemplary embodiment may erroneously detect presence or absence of the sheet S when dew condensation occurs on the reflection member 36.

When many minute water droplets adhere to the reflection member 36 due to the dew condensation, the light emitted from the light-emitting unit 28 is irregularly reflected by the water droplets on the reflection member 36 surface, and a light amount reaching the light-receiving unit 29 is reduced. In that case, if there is no sheet S in the sheet detection mechanism 34, it may be erroneously detect that the sheet S exists. Therefore, according to the present exemplary embodiment, the air blow configuration is required to prevent dew condensation on the reflection member 36.

Figure 16:
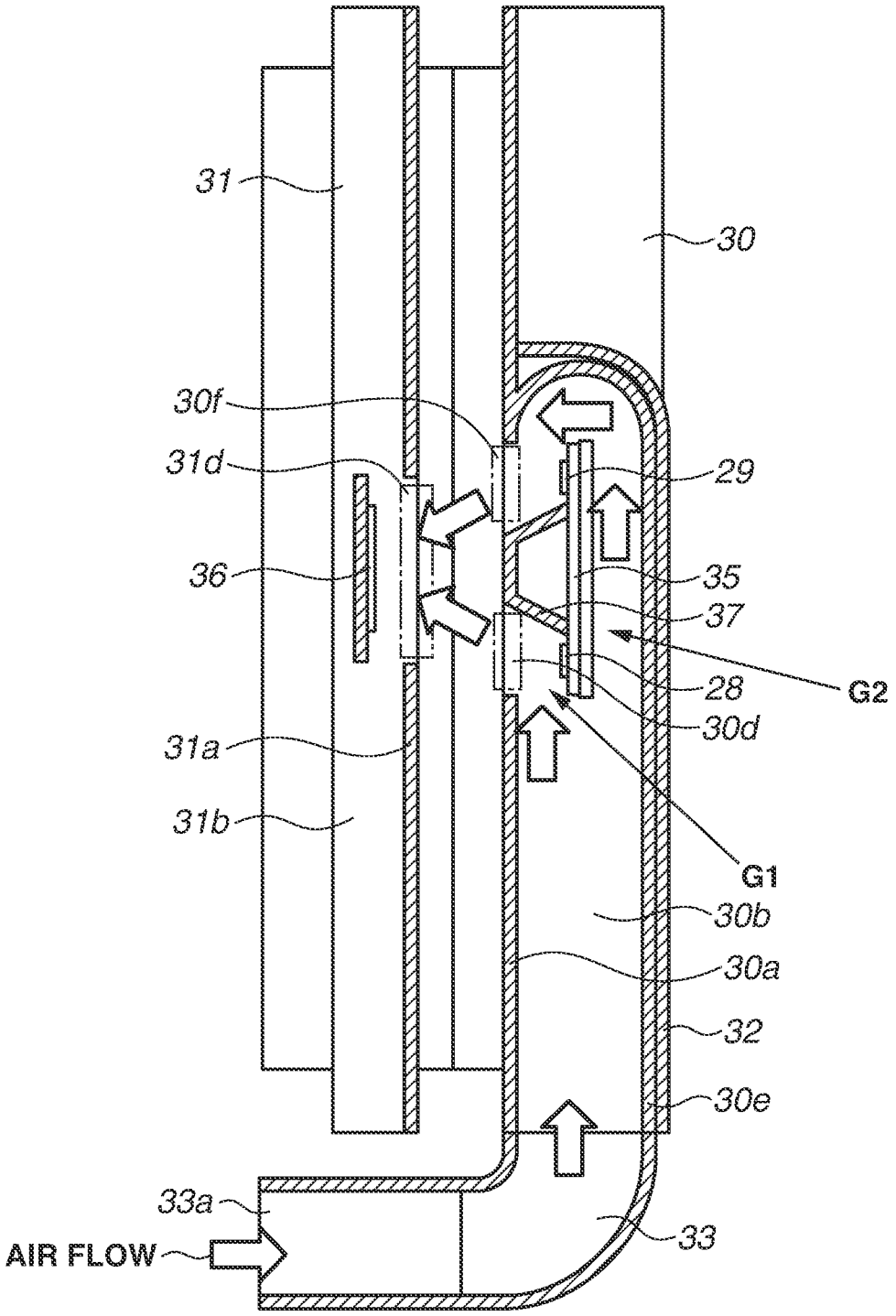
FIG. 16 is a cross-sectional view of an air blow configuration in the sheet detection mechanism according to the second exemplary embodiment.

According to the present exemplary embodiment, the lid member 32 and the duct member 33 are configured as described in the first exemplary embodiment, and the descriptions thereof are omitted since the same contents. First, FIG. 16 is a cross-sectional view of the air blow configuration in the sheet detection mechanism 34. The substrate 35 forming the light-emitting unit 28 and the light-receiving unit 29 is disposed on an inner side of the air duct than the exhaust guide 30*e*, and a gap G2 is provided between the substrate 35 of the light-emitting unit 28 and the light-receiving unit 29 and the exhaust guide 30*e*. The gap G2 passes from the exhaust guide 30*e* formed in a curved shape and leads to the opening portion 30*f* of the first guide unit 30 through the light-receiving unit 29. In addition, a gap G1 is provided between the sheet passing portion 30*a* of the first guide unit 30 and the light-emitting unit 28 and leads to the opening portion 30*d* of the first guide unit 30.

Next, an air flow is described. First, air is blown from a fan, which is not illustrated, disposed inside the image forming apparatus main body 100. Next, the blown air is taken into the guide portion 33*a* of the duct member 33. The air blow is sent to the air duct which is bent at a right angle from the guide portion 33*a* and formed by the sheet passing portion 30*a*, the bottom surface portion 30*b*, and the exhaust guide 30*e* of the first guide unit 30 and the lid member 32. The air blow is branched into two directions of the gaps G1 and G2.

The air passing through a first air duct provided with the gap G1 passes the gap G1 between the sheet passing portion 30*a* of the first guide unit 30 and the light-emitting unit 28, further passes from the opening portion 30*d* to the opening portion 31*d* across the sheet conveyance path, and reaches the reflection member 36.

The air passing through a second air duct provided with the gap G2 passes the gap G2 and reaches the light-receiving unit 29. The air further passes through a gap between the light-receiving unit 29 and the exhaust guide 30*e*, passes from the opening portion 30*f* to the opening portion 31*d* across the sheet conveyance path, and reaches the reflection member 36. The air blow through the first and second air ducts cools the light-emitting unit 28 and the light-receiving unit 29 and prevents water vapor from entering from the opening portions 30*d*, 30*f*, and 31*d* of the sheet detection mechanism 34. The above-described air blow configuration prevents the light-emitting unit 28 and the light-receiving unit 29 from becoming high temperature and prevents dew condensation in the light-emitting unit 28, the light-receiving unit 29, and the reflection member 36.

As described above, according to the present exemplary embodiment, the configuration is described in which both of the light-emitting unit 28 and the light-receiving unit 29 are arranged away from the fixing film 19*a*, and the duct is provided only one of the two guide units but the optical element units respectively disposed on both of the two guide units are cooled. Accordingly, the light-emitting unit 28 and the light-receiving unit 29 can be thermally protected, and air can be supplied to the light-emitting unit 28, the light-receiving unit 29, and the reflection member 36 while suppressing enlargement of the apparatus.

Next, a third exemplary embodiment is described with reference to FIGS. 17 and 18. The same components and components having the same functions as those of the first and the second exemplary embodiments are denoted by the same reference numerals, and descriptions thereof are omitted. A first optical element unit in the sheet detection mechanism according to the present exemplary embodiment includes a light-receiving unit and a reflection member for forming an optical path between the light-receiving unit and a second optical element unit. The second optical element unit includes a light-emitting unit for emitting light advancing toward the light-receiving unit of the first optical element unit.

(Description of Basic Configuration and Operation of Sheet Detection Mechanism)

If a sheet detection mechanism 38 is disposed on a position easily affected by an external light source, such as a sheet discharge port of the image forming apparatus, the sheet detection mechanism 38 may cause erroneous detection due to stray light. As the size of the image forming apparatus main body is reduced, a possibility that the stray light enters is increased.

Figure 17:
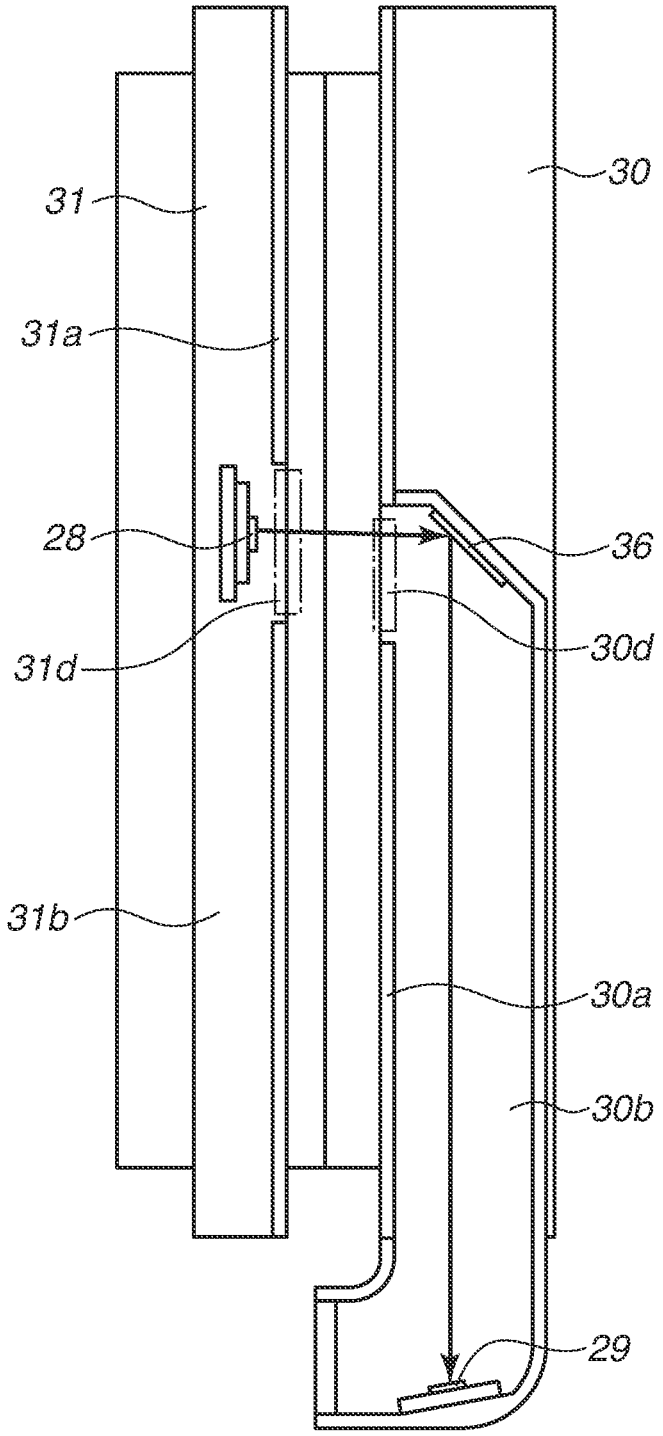
FIG. 17 is a cross-sectional view of a sheet detection mechanism according to a third exemplary embodiment.

Thus, according to the present exemplary embodiment, a configuration is described which prevents erroneous detection by disposing the light-receiving unit 29 on a position at which the stray light hardly reaches as illustrated in FIG. 17. The light-receiving unit 29 and the reflection member 36 are disposed on the exhaust guide 30*e* of the first guide unit 30. The light-receiving unit 29 is disposed on a position away from the opening portion 30*d* of the first guide unit 30, and thus there is little possibility that light other than that from the light-emitting unit 28 directly reaches the light-receiving unit 29. Further, the light other than that from the light-emitting unit 28 hardly reaches the light-receiving unit 29 because of regular reflection from the reflection member 36. The light-emitting unit 28 is disposed on the second guide unit 31.

Next, a sheet detection operation is described. The light from the light-emitting unit 28 enters from the opening portion 31*d* of the second guide unit 31 to the opening portion 30*d* of the first guide unit 30 across the sheet conveyance path and reaches the reflection member 36. The illuminating light is reflected on the surface of the reflection member 36 and reaches the light-receiving unit 29. Accordingly, an electric current flows in the light-receiving unit 29, and the sheet detection mechanism 38 becomes a state in which the sheet S is not detected. A state that the sheet detection mechanism 38 detects the sheet S is similar to that according to the second exemplary embodiment, and thus the description thereof is omitted.

(Description of Air Blowing Configuration and Air Flow)

Figure 18:
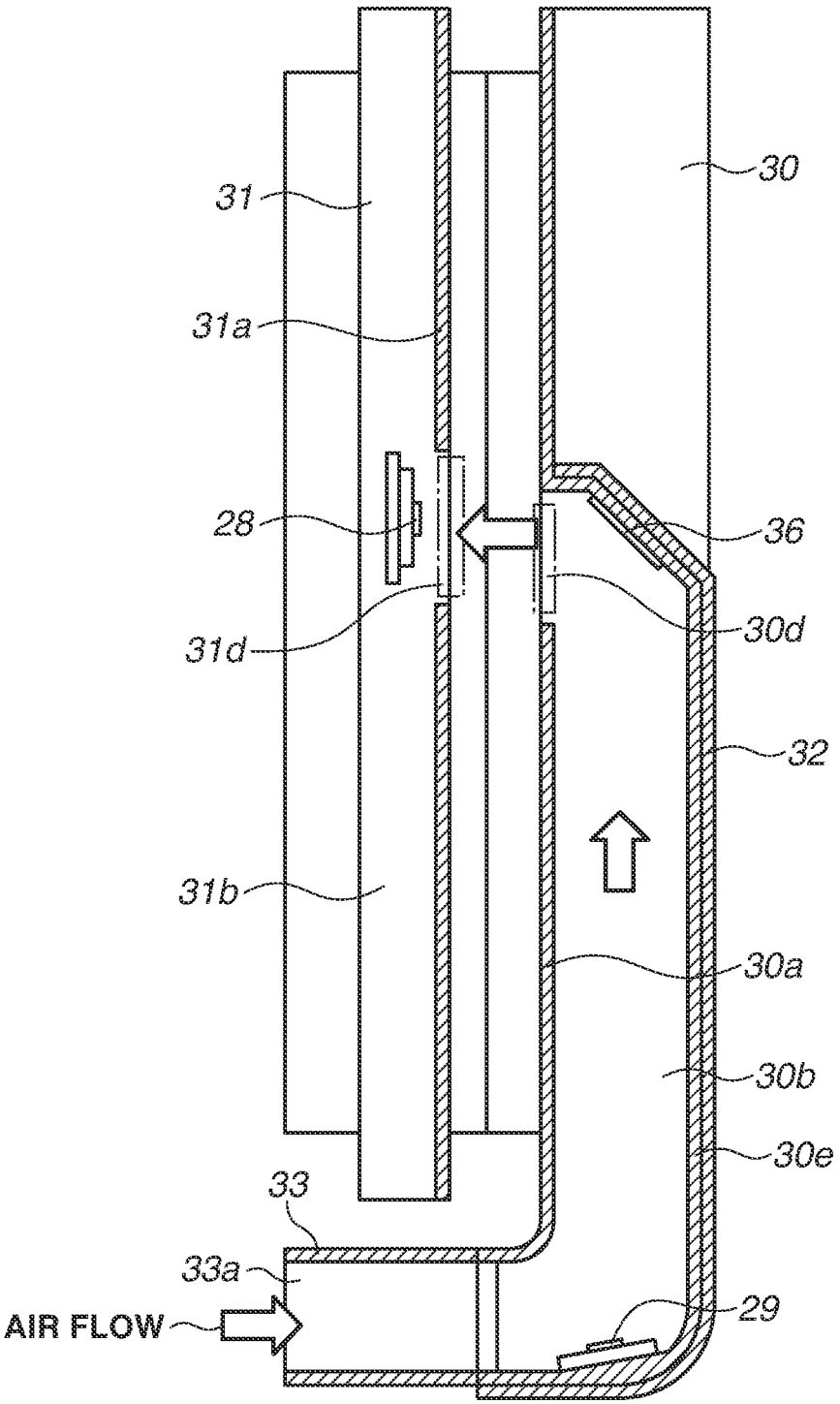
FIG. 18 is a cross-sectional view of the sheet detection mechanism according to the third exemplary embodiment.

FIG. 18 illustrates an air flow in the duct. FIG. 18 illustrates that the air first hits the light-receiving unit 29, then hits the reflection member 36, passes through the opening portions 30*d* and 31*d*, and finally hits the light-emitting unit 28. Accordingly, the optical element units are suppressed from temperature rise.

Figure 19:
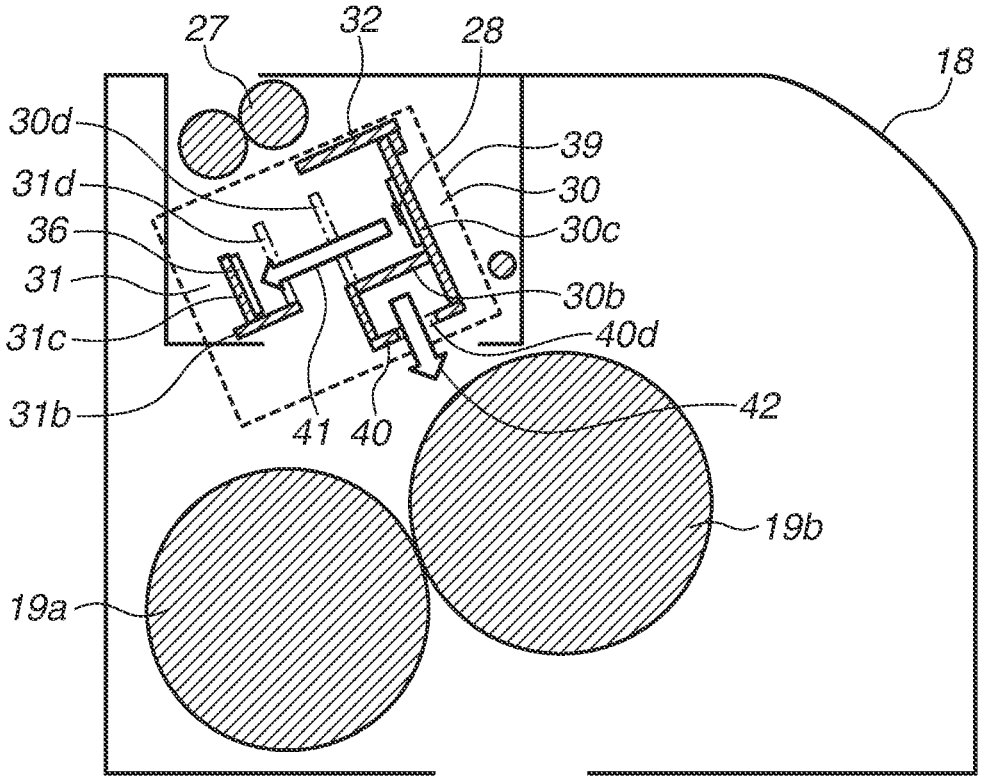
FIG. 19 is a cross-sectional view of a sheet detection mechanism according to a fourth exemplary embodiment.
Figure 20A:
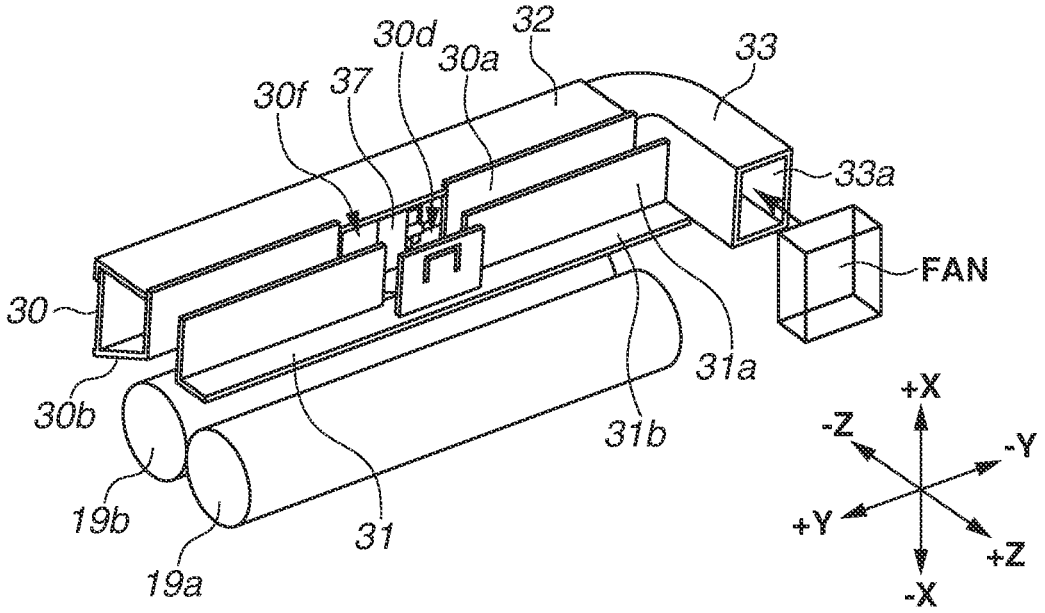
FIGS. 20A and 20B are perspective views of the sheet detection mechanism according to the fourth exemplary embodiment.
Figure 20B:
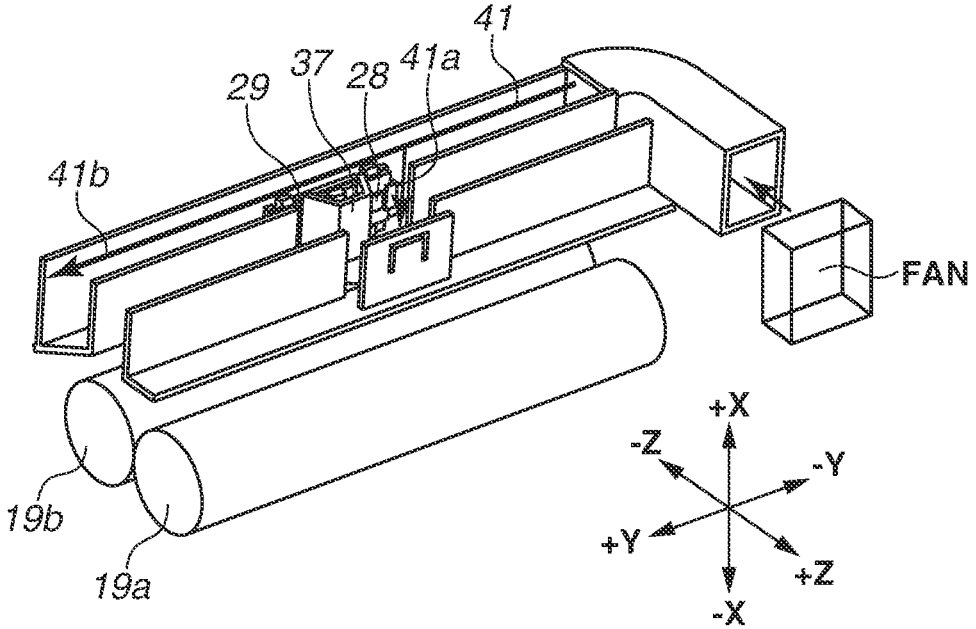
Figure 21A:
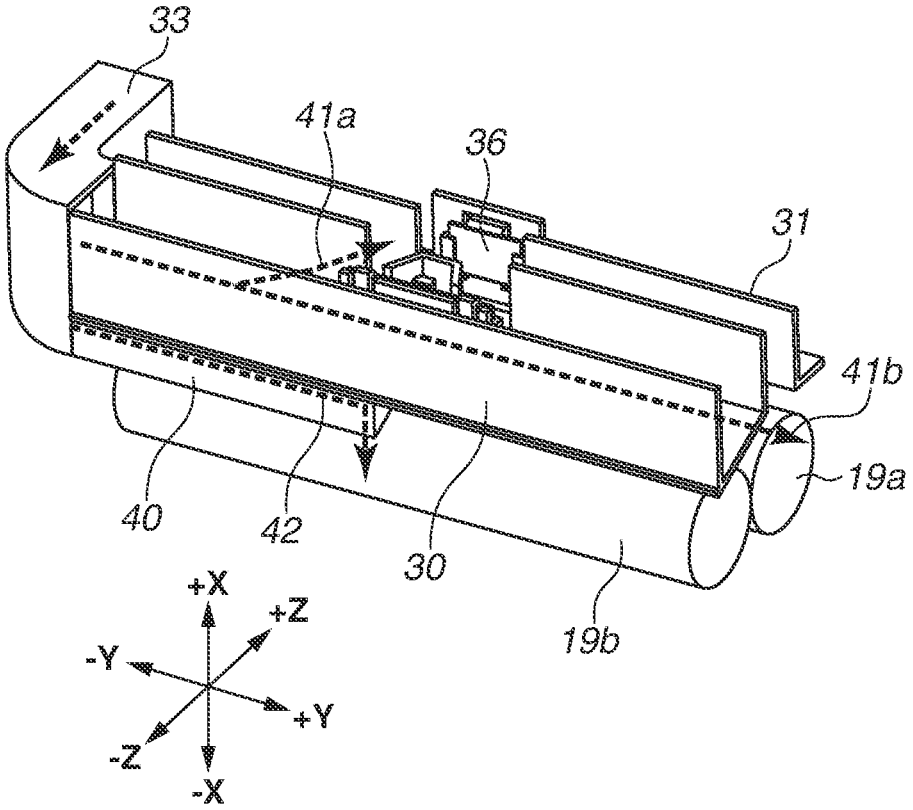
FIGS. 21A and 21B are perspective views of the sheet detection mechanism according to the fourth exemplary embodiment.
Figure 21B:
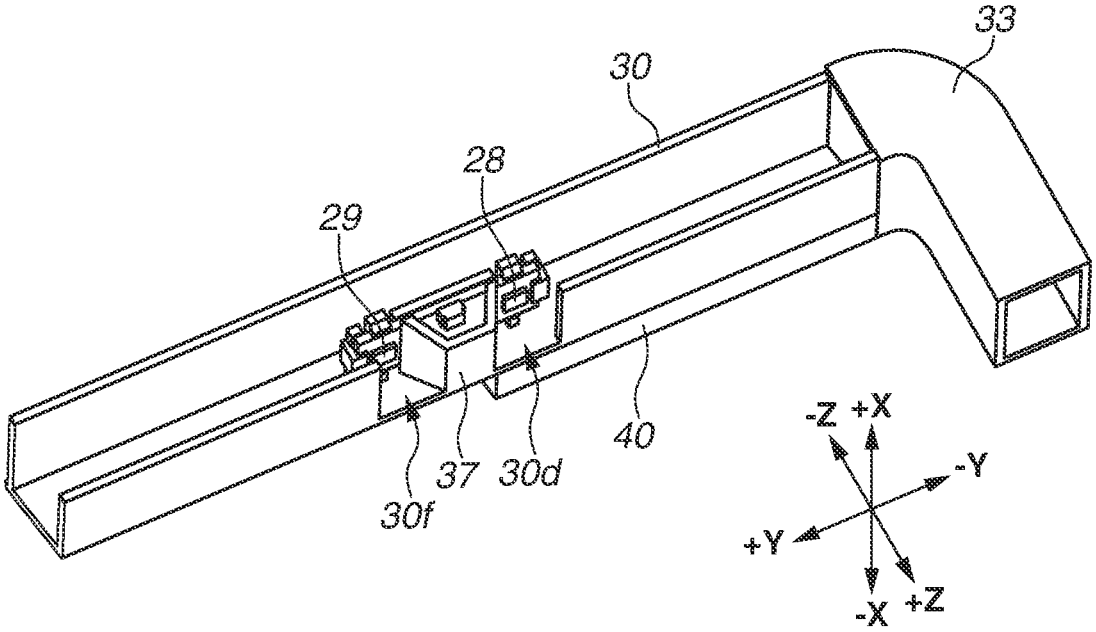

Next, a fourth exemplary embodiment is described with reference to FIGS. 19 to 22. The same components and components having the same functions as those of the first to the third exemplary embodiments are denoted by the same reference numerals, and descriptions thereof are omitted. FIG. 19 is a cross-sectional view of the fixing unit 18 at a position of the sensor unit in a pressure roller axial direction (the Y-axis direction). FIG. 20A is a perspective view of the fixing unit 18, and FIGS. 20B, 21A, 21B, and 22A are views showing inside of the duct by removing a component 32 from FIG. 20A.

(Description of Basic Configuration and Operation of Sheet Detection Mechanism)

The apparatus according to the present exemplary embodiment can suppress dew condensation in the light-emitting unit 28 and the light-receiving unit 29 of the sheet detection mechanism 20 in the case of instantaneous interruption of power supply to the printer main body.

When continuous printing is performed on a plurality of moisture absorbed sheets S, high temperature water vapor generated from the sheet S when the sheet S passes through the fixing nip portion N is retained inside the fixing unit 18. Especially, the water vapor is retained in a space enclosed by the fixing film 19*a*, the pressure roller 19*b*, and guide units 30 and 31. Since the air blow to the sheet detection mechanism 20 is continued after completion of printing, the water vapor retained inside the fixing unit 18 usually does not flow backward from the sheet conveyance path via the opening portions 30*d*, 30*f*, and 31*d* and reach the light-emitting unit 28, the light-receiving unit 29, and the reflection member 36. However, when power supply to the printer main body is instantaneously interrupted by reason of power outage, disconnection of power cable, and the like during printing, power supply to the fan, which is not illustrated, for blowing air to the sheet detection mechanism 20 is instantaneously interrupted. In that case, a part of the water vapor retained inside the fixing unit 18 may enter from the sheet conveyance path via the opening portions 30*d*, 30*f*, and 31*d* of the sheet detection mechanism 20 and reach the light-emitting unit 28, the light-receiving unit 29, and the reflection member 36, and dew condensation may occur therein.

Thus, according to the present exemplary embodiment, water vapor generated during printing is constantly diffused during printing so as not to retain in the space enclosed by the fixing film 19*a*, the pressure roller 19*b*, and the guide units 30 and 31. In the configuration of the sheet detection mechanism 20 according to the present exemplary embodiment, the air duct sending air to the sheet detection mechanism 20 is branched into a first air duct 41 (41*a* and 41*b*) and a second air duct 42 in the middle. The first air duct 41 is used to send air to the light-emitting unit 28 and the reflection member 36 of the sheet detection mechanism 20 (a route of an arrow 41*a*). The second air duct 42 is used to send air to the inside of the fixing unit 18 so as to make water vapor harder to retain inside the fixing unit 18. Accordingly, in the case of instantaneous interruption of power supply to the printer main body, water vapor entering from the opening portions 30*d*, 30*f*, and 31*d* of the sheet detection mechanism 20 can be reduced, and dew condensation in the light-emitting unit 28, the light-receiving unit 29, and the reflection member 36 can be suppressed. The air duct 41*b* is a route sending air to a mechanism other than the fixing unit 18 in the printer.

(Description of Air Blowing Configuration and Air Flow)

In FIG. 20A, air sent from the fan passes through the hollow duct member 33 and then is branched into the first air duct 41 formed by the lid member 32 and the first guide unit 30 and the second air duct 42 formed by a hollow duct member 40. The first air duct 41 is a passage for sending air to the light-emitting unit 28 and the reflection member 36. The second air duct 42 is a passage for sending air from an opening portion 40*d* of the duct member 40 to the inside of the fixing unit 18. The opening portion 40*d* is provided at a position facing an approximately center portion in an axial direction of the pressure roller 19*b* (the Y-axis direction), and the air passing through the opening portion 40*d* is sent toward the space enclosed by the fixing film 19*a*, the pressure roller 19*b*, and the guide units 30 and 31. The air blow can suppress retention of water vapor inside the fixing unit 18.

As illustrated in FIG. 19, the air coming out from the second air duct 42 is sent to directly hit the pressure roller 19*b* inside the fixing unit 18. When the air is sent to directly hit the fixing film 19*a*, the surface temperature of the fixing film 19*a* is lowered, and a fixing property of a toner image on the sheet S may be deteriorated. Compared to air blow to the fixing film 19*a*, air blow to the pressure roller 19*b* can suppress lowering of the surface temperature of the fixing film 19*a*, and influence to the fixing property is relatively small. Therefore, air blow to the inside of the fixing unit 18 via the second air duct 42 is desirable to blow air to the pressure roller 19*b*.

Figure 22A:
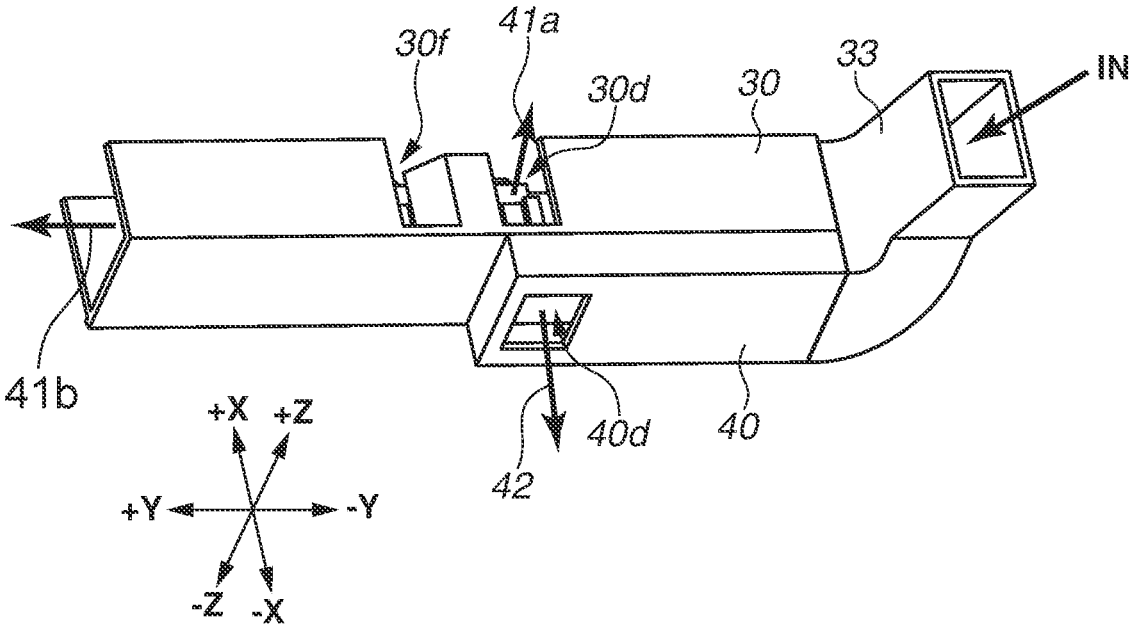
FIGS. 22A and 22B are perspective views of the sheet detection mechanism according to the fourth exemplary embodiment and a modification.
Figure 22B:
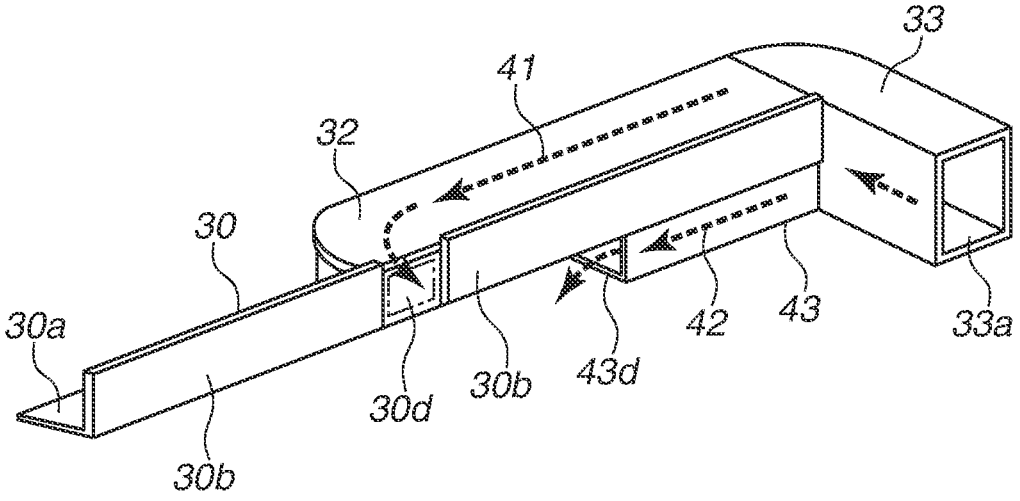

The air blow configuration via the second air duct is not limited to the above-described configuration, and another air blow configuration may be adopted. An example of the other air blow configuration is illustrated in FIG. 22B. A direction of an opening portion 43*d* may be set so that a direction of air from the opening portion 43*d* of a duct member 43 become approximately parallel to the axial direction of the pressure roller 19*b*.

According to the configuration in the present exemplary embodiment, one air duct is branched into an air duct for sending air to the optical element units of the sheet detection mechanism 20 and an air duct for sending air to the inside of the fixing unit 18, and accordingly the image forming apparatus can be miniaturized.

Next, a fifth exemplary embodiment is described. The same components and components having the same functions as those of the first to the fourth exemplary embodiments are denoted by the same reference numerals, and descriptions thereof are omitted.

(Description of Basic Configuration and Operation of Sheet Detection Mechanism)

A configuration is described which can improve productivity when a sheet S to be conveyed is a small size sheet. A small size sheet represents a sheet of which a width is smaller than a sheet having a maximum width which can be used in a printer in a width direction perpendicular to a conveyance direction.

When air is sent to the inside of the fixing unit via the second air duct as according to the fourth exemplary embodiment, temperatures of the fixing members such as the fixing film 19*a* and the pressure roller 19*b* are lowered. Especially, when air directly hits the fixing film 19*a*, the toner fixing property may be deteriorated by lowering of a surface temperature as described above. However, even when air is sent to the pressure roller 19*b*, there is an influence. When air is sent to the pressure roller 19*b*, a surface temperature of the pressure roller 19*b* is lowered, and the surface temperature of the fixing film 19*a* is also slightly lowered which abuts on the pressure roller and rotates. The lowering of temperature also affects the temperature of the heater 50, and more electricity is required to maintain the heater temperature detected by the temperature detection unit 51*a* at a predetermined temperature. In other words, a heat quantity to be supplied from the heater 50 to the fixing film 19*a* is increased by an influence of the air from the second air duct.

According to the air blow configuration by the second air duct 42 to the inside of the fixing unit 18, air is strongly blown near a center portion in a longitudinal direction (an axial direction) of the pressure roller 19*b*. Therefore, a temperature difference occurs in the longitudinal direction of the pressure roller 19*b*, the temperature near the center portion in the longitudinal direction at which the air is blown strongly becomes lower, and a temperature near an edge portion in the longitudinal direction at which the air is blown mildly becomes higher. An area near the edge portion in the longitudinal direction at which the temperature of the pressure roller 19*b* becomes higher corresponds to a non-sheet passing area through which a large size sheet passes but a small size sheet does not pass. Therefore, especially when printing is continuously performed on small size sheets (when fixing processing is performed), the non-sheet passing area of the pressure roller 19*b* further accumulates heat, and temperature is increased. Accordingly, a temperature of the non-sheet passing area detected by the temperature detection units 51*b* and 51*c* is increased.

The apparatus according to the present exemplary embodiment performs the control same as that described according to the first exemplary embodiment, more specifically, when a detected temperature of the temperature detection units 51*b* and 51*c* exceeds a predetermined threshold temperature, the apparatus suspends sheet conveyance of a next sheet (extends a sheet passing interval) until the detected temperature becomes the threshold temperature or lower. During this extended period, the fixing film 19*a* is rotated to eliminate temperature unevenness.

As described above, when a heat quantity to be supplied from the heater 50 to the fixing film 19*a* is increased, a temperature increase amount detected by the temperature detection units 51*b* and 51*c* becomes larger, and a time until the temperature reaches the above-described threshold temperature becomes shorter. In addition, a time for rotating the fixing film 19*a* until the temperature detected by the temperature detection units 51*b* and 51*c* becomes the threshold temperature or lower is elongated, and productivity of the sheet S is lowered. The influence thereof is larger as a width of the sheet S is narrower, namely, the non-sheet passing area is larger.

On the other hand, a sheet having narrower width generates less water vapor amount, and a water vapor amount retained inside the fixing unit 18 is reduced. Therefore, when a small size sheet is passed, an air amount necessary for preventing water vapor from retaining inside the fixing unit 18 is reduced, and an air amount sent to the inside of the fixing unit 18 via the second air duct 42 can be relatively less amount.

Thus, according to the present exemplary embodiment, an air amount to be sent to the pressure roller 19*b* via the second air duct 42 (see the fourth exemplary embodiment) can be changed in response to a sheet width of the sheet S. When the sheet width of the sheet S is small, the air amount to be sent to the pressure roller 19*b* via the second air duct is reduced in a range that the light-emitting unit 28 and the light-receiving unit 29 of a sheet detection mechanism 39 do not cause dew condensation. The air amount sent to the pressure roller 19*b* is reduced, and accordingly lowering of the surface temperature near the center portion in the longitudinal direction of the pressure roller 19*b* can be lessen, and the heat quantity to be supplied from the heater 50 to the fixing film 19*a* can be suppressed from increasing. In addition, the temperature increase amount in the non-sheet passing area detected by the temperature detection units 51*b* and 51*c* can be suppressed, and the productivity of the sheet S can be suppressed from lowering.

(Description of Air Blowing Configuration and Air Flow)

The configurations of the sheet detection mechanism 39, the lid member 32, the duct member 33, and the duct member 40 according to the present exemplary embodiment are the same as those according to the fourth exemplary embodiment, and thus descriptions thereof are omitted. According to the present exemplary embodiment, the rotation number of a fan sending air to the duct member 33 can be changed, and the air amount supplied to the inside of the fixing unit 18 via the second air duct 42 is changed in response to the sheet width of the sheet S.

Relationships between the sheet width of the sheet S and an air amount supplied to the duct member 33 according to the present exemplary embodiment are shown in Table 1. When an air amount in the case that a sheet width W of the sheet S is A4 or larger (210 mm≤W) is regarded as 100%, the air amount is regarded as 75% when the sheet width W of the sheet S is A5 or larger and smaller than A4 (148 mm≤W<210 mm), and the air amount is regarded as 50% when the sheet width W of the sheet S is smaller than A5 (W<148 mm). According to the above-described configuration, productivity of a small size sheet can be improved while suppressing dew condensation in the light-emitting unit 28 and the light-receiving unit 29 of the sheet detection mechanism 39.

TABLE 1

| | Sheet width W | | |
|---|---|---|---|
| | A4 or larger (210 mm ≤ W) | A5 or larger and smaller than A4 (148 mm ≤ W < 210 mm) | smaller than A5 (W < 148 mm) |
| Air amount | 100% | 75% | 50% |

Figure 23A:
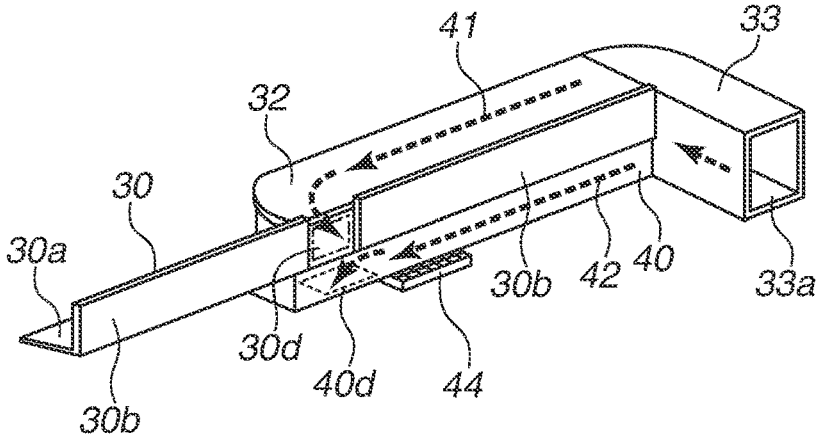
FIGS. 23A to 23C are perspective views of a sheet detection mechanism and a mesh member according to a modification of a fifth exemplary embodiment.
Figure 23B:
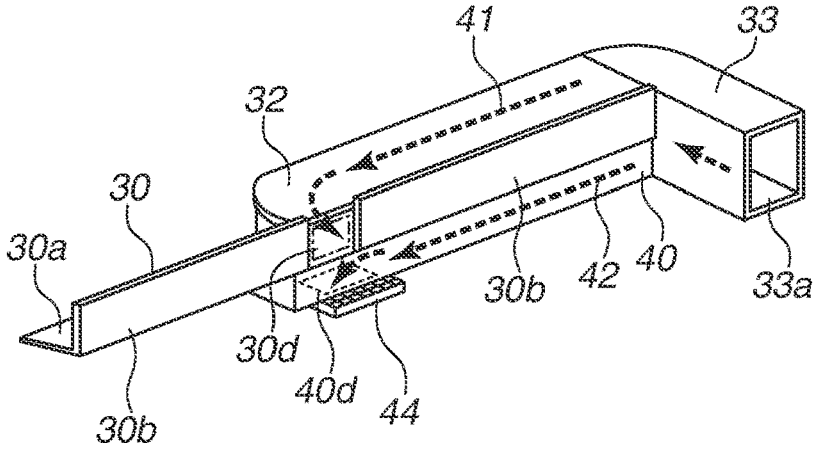
Figure 23C:
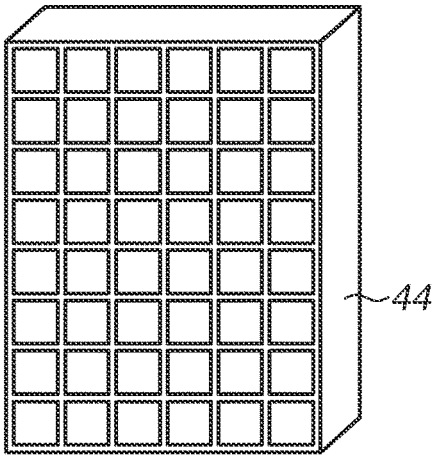

As long as a configuration is to suppress an air amount sent to the inside of the fixing unit when a small size sheet passes than an air amount sent when a maximum size sheet passes, a configuration other than that according to the present exemplary embodiment may be used. An example of an air blow configuration other than that according to the present exemplary embodiment is illustrated in FIGS. 23A to 23C. FIGS. 23A and 23B illustrate the air blow configuration in which a mesh member 44 illustrated in FIG. 23C is attached to the opening portion 40*d* in a retreatable manner. FIG. 23A illustrates a state in which the mesh member 44 is retreated from the opening portion 40*d*, and FIG. 23B illustrates a state in which the mesh member 44 faces the opening portion 40*d*. When passing of a small size sheet is detected, the mesh member 44 is moved from the state in FIG. 23A to that in FIG. 23B. Accordingly, the air amount sent from the opening portion 40*d* to the inside of the fixing unit 18 can be reduced, temperature rise near the edge portion in the longitudinal direction of the pressure roller 19*b* can be suppressed, and productivity of a small size sheet can be improved.

Next, a sixth exemplary embodiment is described. The same components and components having the same functions as those of the first to the fifth exemplary embodiments are denoted by the same reference numerals, and descriptions thereof are omitted.

(Description of Fixing Unit)

Figure 24A:
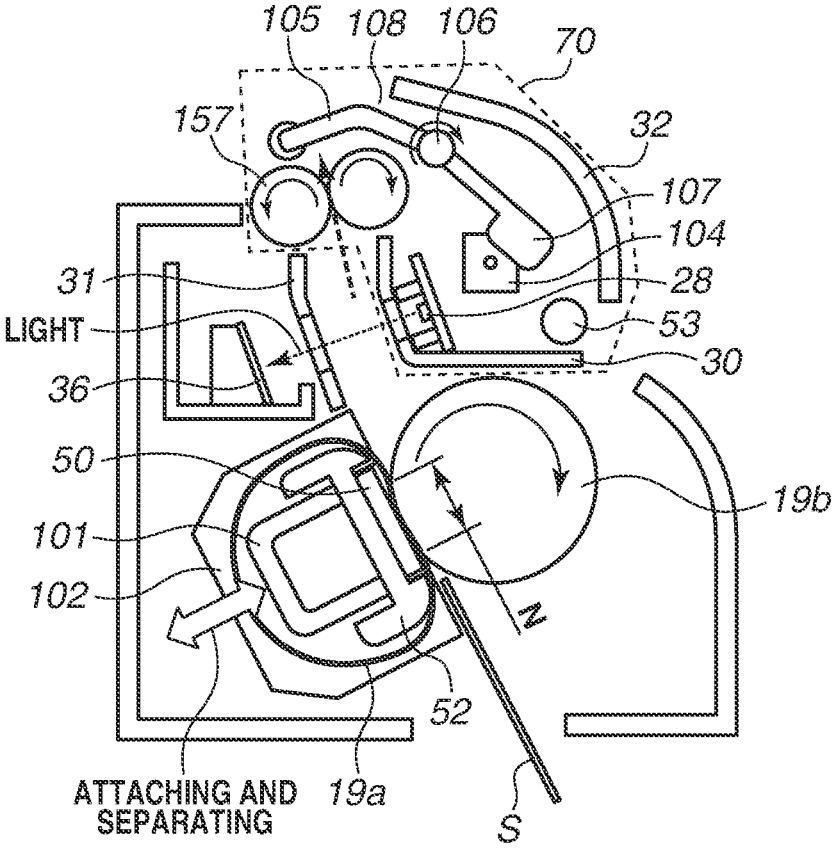
FIGS. 24A and 24B are cross-sectional views of a fixing unit according to a sixth exemplary embodiment.

FIG. 24A is a cross-sectional view of a fixing unit. The fixing unit includes a stay 101 having a U-shaped cross section. The stay 101 is disposed inside of the film guide 52. A travelling locus of the fixing film 19*a* is regulated by flanges 102 and 103 disposed to face both edge portions in the longitudinal direction of the fixing film 19*a*. According to the present exemplary embodiment, an edge surface and an outer peripheral surface of the flange regulates movement of the fixing film 19*a* in the longitudinal direction and the travelling locus of the both edge portions of the fixing film 19*a*. There is the heater 50 and the pressure roller 19*b*. A pressure is applied to a gap between the stay 101 and the pressure roller 19*b*, and thus the fixing nip portion N is formed. A decurl roller 157 corrects curl on the sheet S.

The fixing unit 18 is provided with two sheet detection mechanisms. A first sheet detection mechanism is a non-contact type sensor which is disposed between the fixing nip portion N and the decurl roller pair 157 and optically detects the sheet S.

The non-contact type sensor according to the present exemplary embodiment includes the light-emitting unit 28 and the light-receiving unit 29 disposed inside of the first guide unit 30 on the pressure roller 19*b* and the reflection member 36 disposed inside of the second guide unit 31 on the fixing film 19*a* as described in the second exemplary embodiment. The first guide unit 30 is combined with the lid member 32 serving as a guide in the two-sided conveyance and unitized as the sheet discharge unit 70.

A second sheet detection mechanism is a contact type sensor which is disposed downstream of the decurl roller pair 157 and physically detects the sheet S. The contact type sensor includes a sensor member 104 such as a photo-interrupter disposed inside of the first guide unit 30 on the pressure roller 19*b* and a flag member 108 acting on the sensor member 104. The flag member 108 includes an abutment portion 105 on which the sheet S abuts, a rotation shaft 106, and a light-blocking unit 107 for blocking the light from the sensor member 104. When the sheet S abuts on the abutment portion 105, the flag member 108 rotates centering around the rotation shaft 106, and the light-blocking unit 107 blocks an optical axis of the sensor member 104. Accordingly, presence of the sheet is detected.

These sheet detection mechanisms have following functions. The non-contact type sensor is used for a case in which printing is performed on a sheet hardly transmits the light from the light-emitting unit 28 such as plain paper. The contact type sensor is used for a case in which printing is performed on a sheet easily transmits light such as an overhead projector transparency (OHT). These sensors have a function of generating a trigger signal for switching a position of the diverter 46 illustrated in FIG. 2 and a function of detecting a jam in the fixing nip portion N by detecting an edge portion of a sheet.

Figure 24B:
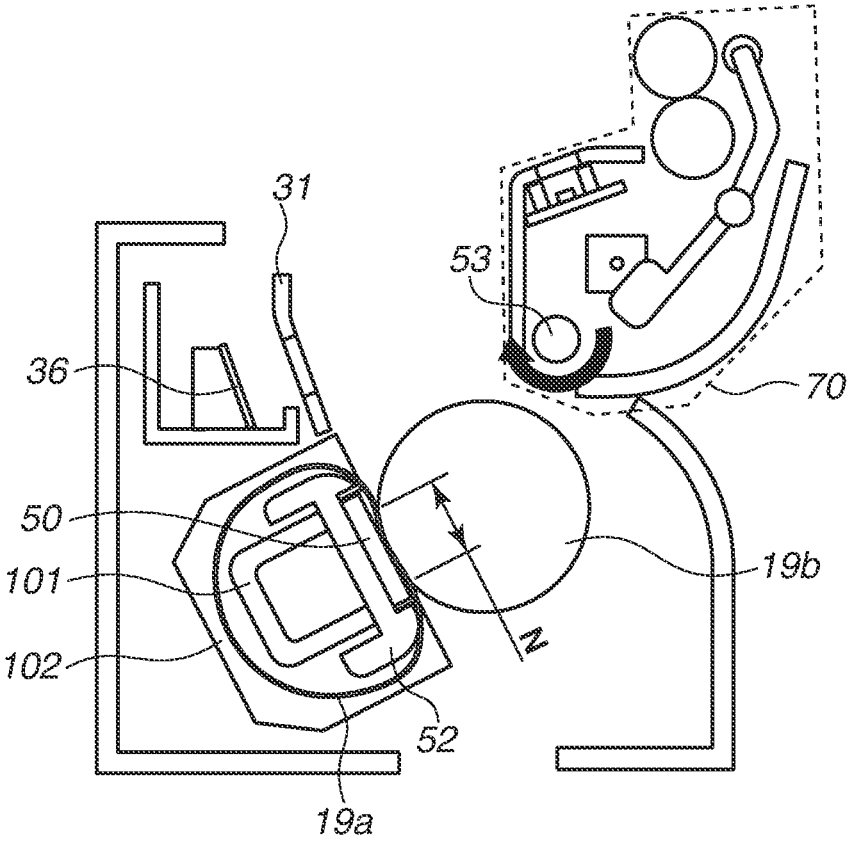

The non-contact type sensor is disposed on a position closer to the fixing nip portion N than the contact type sensor. The reason is described. A print speed is faster when printing is performed on a sheet such as plain paper detected by the non-contact type sensor than when printing is performed on a sheet such as OHT. Thus, a distance that the sheet advances from when a jam of the sheet is detected to when conveyance of the sheet is stopped at the fixing nip portion N is longer in the case of the sheet such as plain paper, and it is necessary to stop the conveyance as quickly as possible. If a distance from the fixing nip portion N to the non-contact type sensor is shortened as much as possible, a degree of bend of the sheet S when a jam occurs can be reduced, and it is easy for a user to perform jam recovery. Further, the contact type sensor is disposed downstream of the decurl roller pair 157, and the fixing unit 18 can be miniaturized. As illustrated in FIGS. 24A and 24B the sheet discharge unit 70 has the shaft 53. FIG. 24A illustrates a normal print state, and when jam recovery is performed, a user takes out the fixing unit 18 from the image forming apparatus main body 100. Further, the sheet discharge unit 70 is rotated centering around the shaft 53 to a position illustrated in FIG. 24B, and the retained sheet S can be removed.

In the case that a jam occurs when the sheet S passes through the fixing nip portion N, it is desirable to separate members forming the fixing nip portion N (the heating unit and the pressure member) to facilitate removal of a jammed sheet. The fixing unit 18 according to the present exemplary embodiment includes a configuration for abutting and separating the heating unit and the pressure member. According to the present exemplary embodiment, the fixing film 19*a* is a portion which is brought into contact with the pressure member in the heating unit brought into contact with an unfixed toner image on a sheet, and the fixing film 19*a* is difficult to be directly rotated. Therefore, the pressure roller 19*b* as the pressure member is driven to rotate, and the fixing film 19*a* is configured to be followingly rotated, and when the heating member and the pressure member abut on and separate from each other, the heating unit having the fixing film 19*a* is only moved.

Figure 25A:
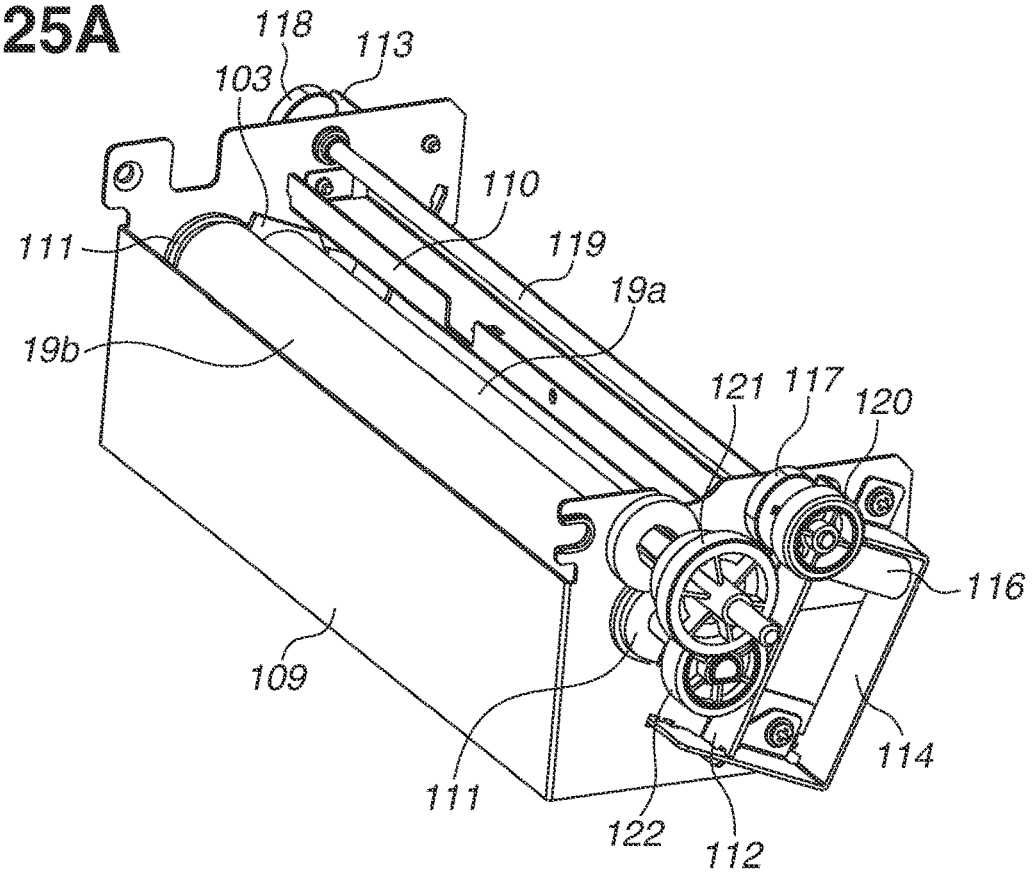
FIGS. 25A and 25B are perspective views of an abutment and separation mechanism in the fixing unit according to the sixth exemplary embodiment.
Figure 25B:
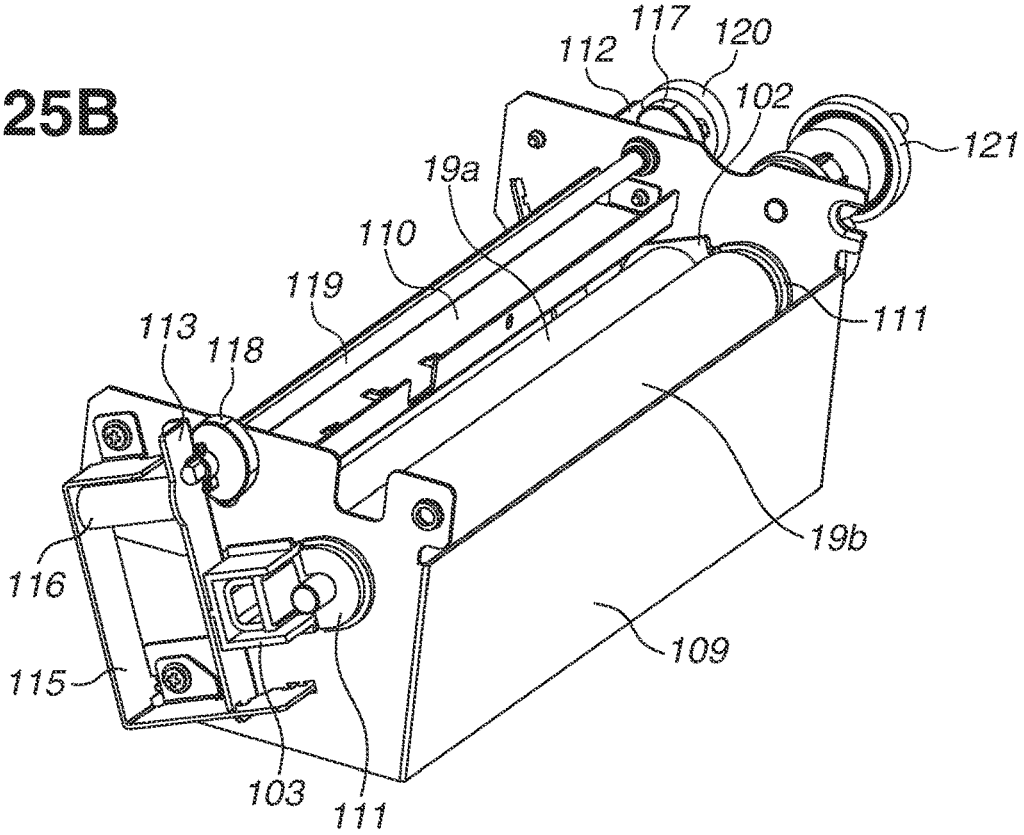

Next, an abutment and separation mechanism of the fixing unit 18 is described. FIGS. 25A and 25B are perspective views of the abutment and separation mechanism in the fixing unit 18. Both edge portions of the pressure roller 19*b* are rotatably supported by a bearing portion 111 attached to a frame constituted of a side plate 109 and an intermediate sheet metal 110. The heating unit is supported by the fixing side plate 109 so as to be able to move in a direction abutting on and separating from the pressure roller 19*b*. The flanges 102 and 103 of the heating unit are pressed by pressure plate 112 and 113, and thus the fixing nip portion N is formed. One edge portions of the pressure plates 112 and 113 are respectively hung on support frames 114 and 115 attached to the side plate 109, and pressure springs 116 for applying pressure to the flanges 102 and 103 are respectively disposed between the support frames 114 and 115 and the pressure plate 112 and 113. Cams 117 and 118 acting on the abutment and separation mechanism are fixed to both ends of a rotation shaft 119.

A gear 120 for transmitting driving to the rotation shaft 119 is provided on one side of the rotation shaft 119. Further, gears 121 and 122 for driving the pressure roller 19*b* are provided, and a driving force from a motor, which is not illustrated, as a driving source installed in the image forming apparatus main body 100 is transmitted to the gears 120, 121, and 122. When it is necessary to release the fixing nip portion N, the force is transmitted to the cams 117 and 118 via the gear 120, and the cams 117 and 118 rotate. When phases of the cams 117 and 118 are changed, the power that the pressure plates 112 and 113 push down the flanges 102 and 103 is changed. Accordingly, the fixing film 19*a* abuts on or separates from the pressure roller 19*b*. When a jam occurs, the both units are separated to release the fixing nip portion N. In a state in which the fixing nip portion N is released, the sheet S jammed in the fixing unit 18 can be easily removed.

Figure 26A:
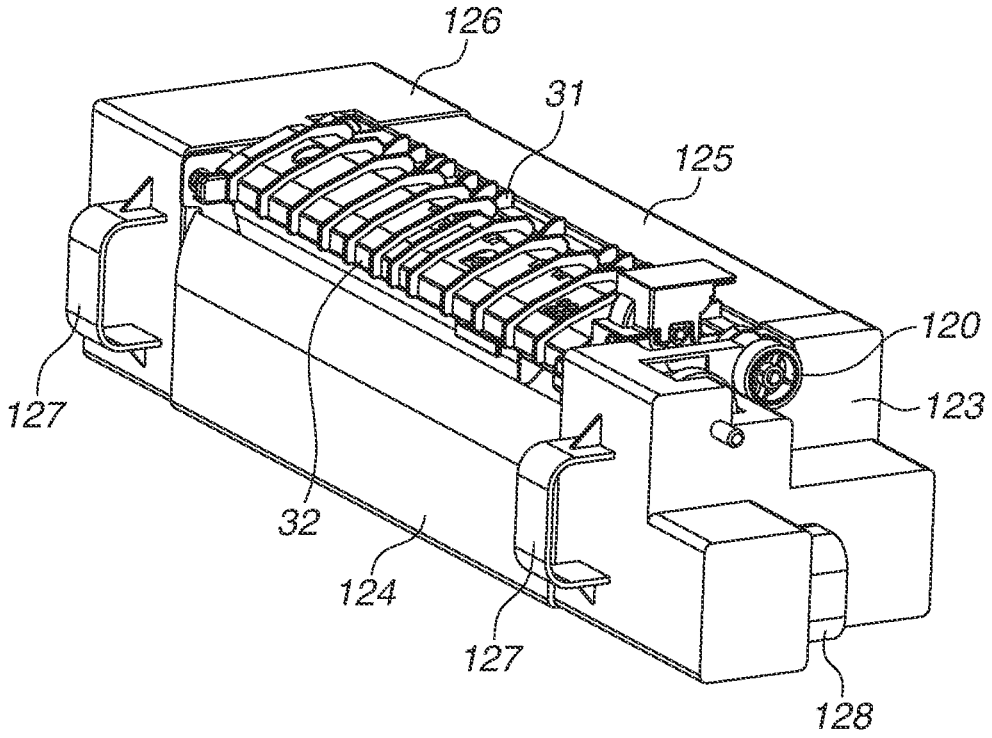
FIGS. 26A and 26B are perspective views of an external appearance of the fixing unit according to the sixth exemplary embodiment.
Figure 26B:
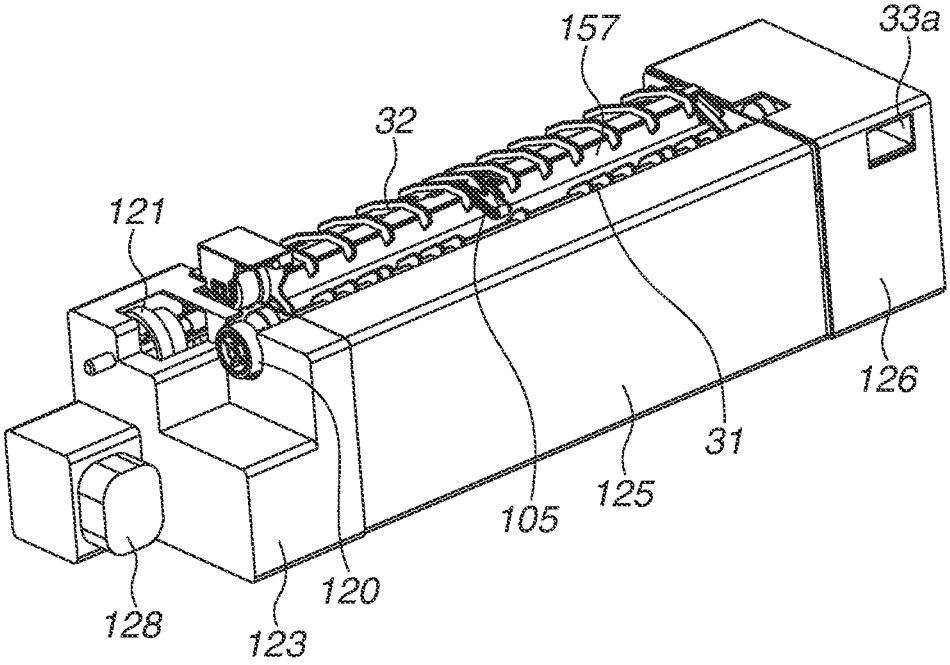

The fixing unit 18 can be attached to and detached from the image forming apparatus main body 100 for replacement of the fixing unit 18 and jam recovery by a user. As illustrated in FIGS. 26A and 26B, the fixing unit is covered with covers 123, 124, 125, and 126. When the fixing unit is taken out from the image forming apparatus main body 100, a user holds a handle 127 and can take out safely and easily. A drawer connector 128 is used for supplying electricity from the image forming apparatus main body 100 to the fixing unit.

(Description of Configuration and Operation of Sheet Detection Mechanism)

Figure 27A:
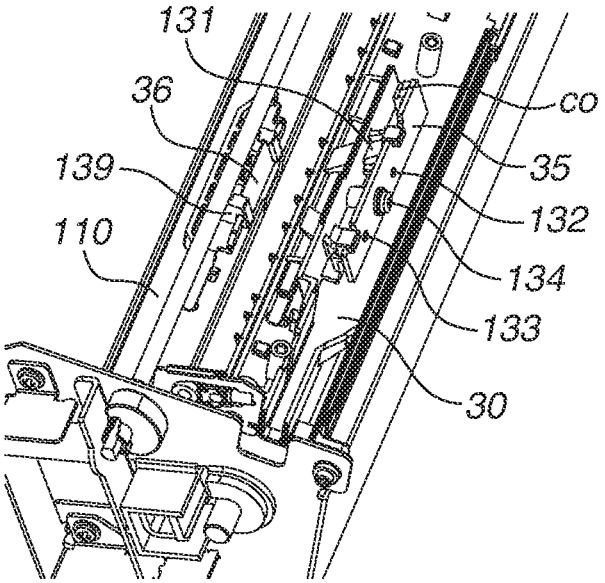
FIGS. 27A to 27C are perspective views of a non-contact type sensor according to the sixth exemplary embodiment.
Figure 27B:
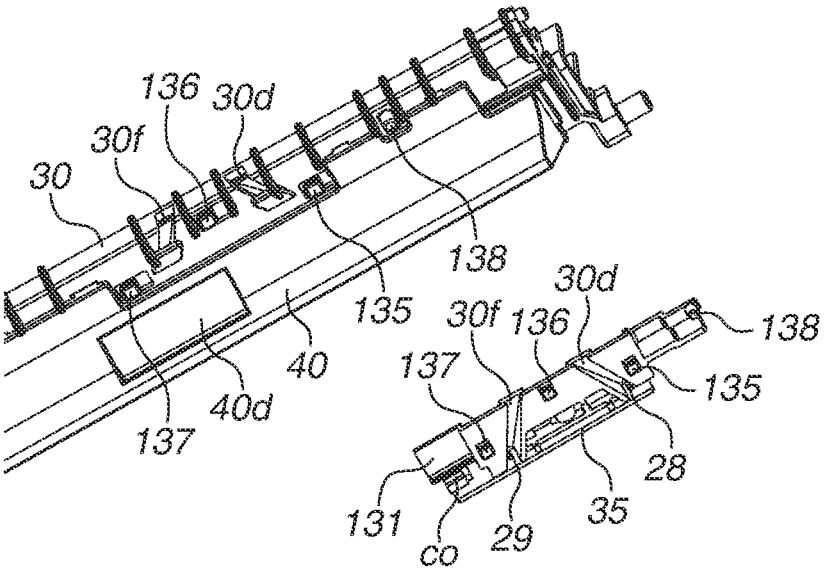
Figure 27C:
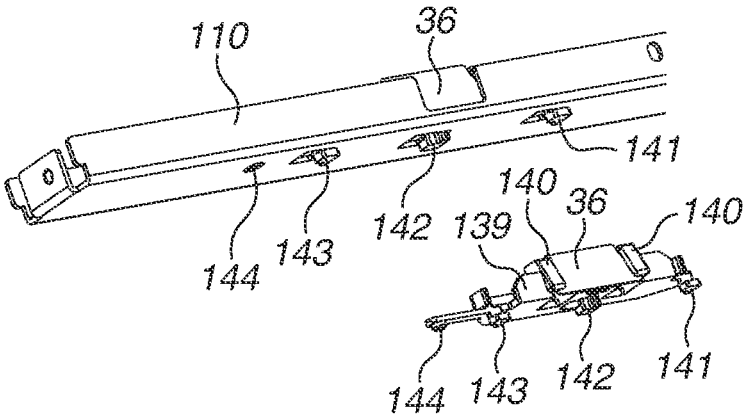

Configurations and operations of the sheet detection mechanism according to the present exemplary embodiment are described. First, a configuration of the non-contact type sensor is described. FIGS. 27A, 27B, and 27C are perspective views of the non-contact type sensor. The substrate 35 on which the light-emitting unit 28 and the light-receiving unit 29 are mounted is positioned by two positioning holes and positioning bosses 132 and 133 of a substrate holder 131 and fixed thereto with a screw 134. The substrate holder 131 is positioned and fixed to the first guide unit 30 by hook portions 135, 136, and 137 and a positioning boss 138. The reflection member 36 is positioned in the longitudinal direction to a reflection member holder 139 by a positioning portion 140 of the reflection member holder 139. Further, the reflection member holder 139 is positioned and fixed to the intermediate sheet metal 110 by hook portions 141, 142, and 143 and a positioning boss 144. Since the reflection member holder 139 is fixed to the intermediate sheet metal 110, the reflection member 36 is configured not to fall off from the reflection member holder 139.

Figure 28:
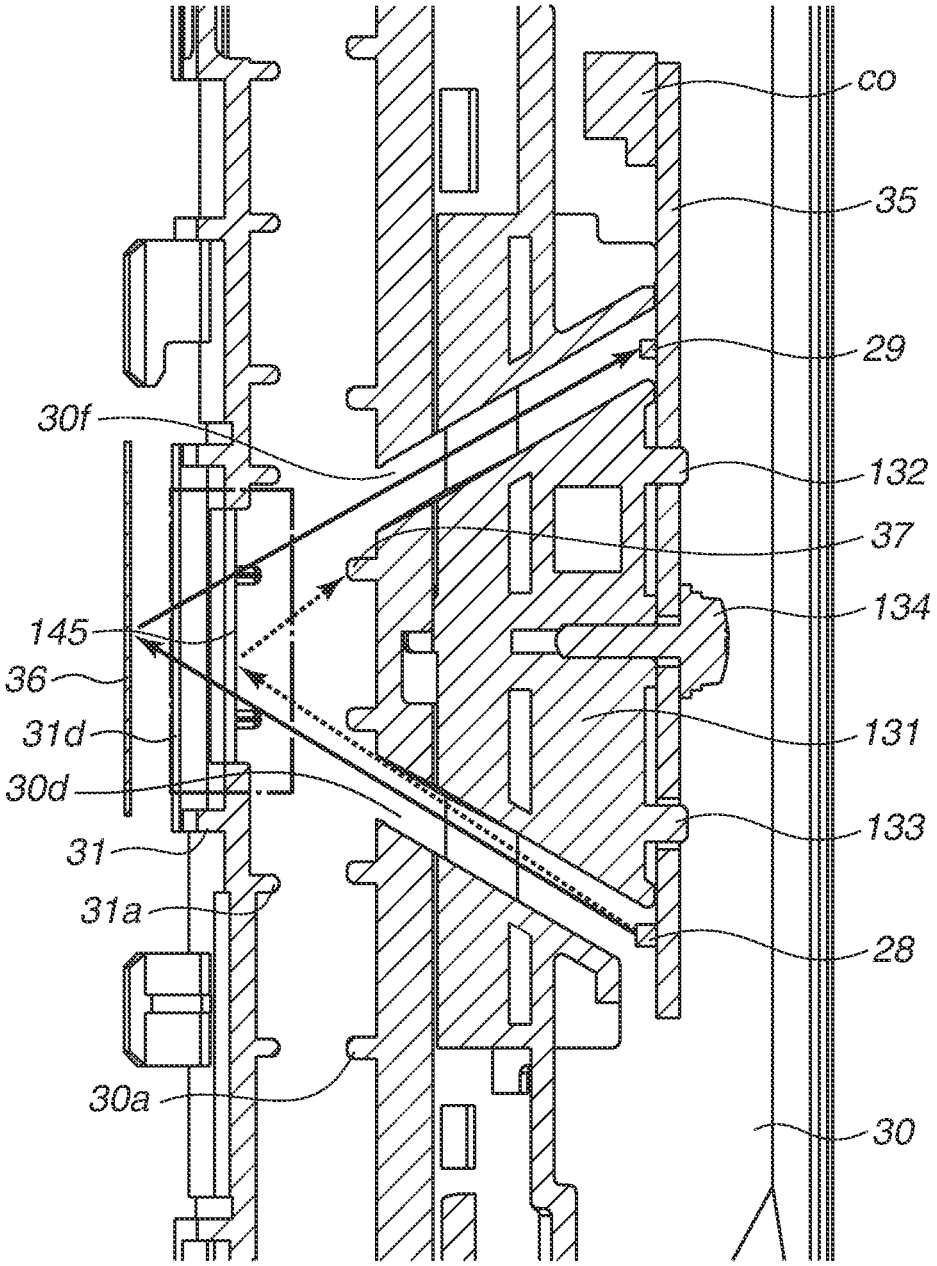
FIG. 28 is a cross-sectional view of a sheet detection mechanism according to the sixth exemplary embodiment.

FIG. 28 is a cross-sectional view relating an optical path of the non-contact type sensor. An optical path through which the light from the light-emitting unit 28 passes and an optical path in which light reflected from the reflection member 36 advances toward the light-receiving unit 29 are formed by the first guide unit 30, the substrate holder 131, and the reflection member holder 139. The first guide unit 30 is provided with the opening portions 30*d* and 30*f*. The second guide unit 31 is provided with the opening portion 31*d* for forming the optical path advancing from the light-emitting unit 28 to the reflection member 36 and the optical path advancing from the reflection member 36 to the light-receiving unit 29. Even if the sheet S is conveyed along a flat portion 145 of the second guide unit 31, light reflected on the sheet S surface is blocked by the light-blocking rib 37 of the first guide unit 30 (an optical path indicated by dashed line arrows). Thus, there is no chance of erroneously detecting as absence of sheet even the sheet is conveyed. The above-described operations of the non-contact type sensor are described in the second exemplary embodiment, thus detailed description thereof are omitted.

Figure 29A:
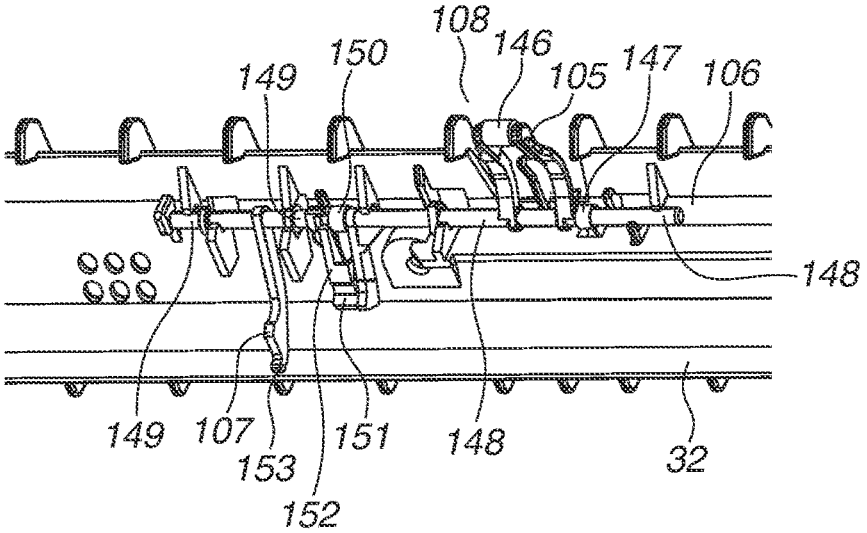
FIGS. 29A to 29C are perspective views of a contact type sensor according to the sixth exemplary embodiment.
Figure 29B:
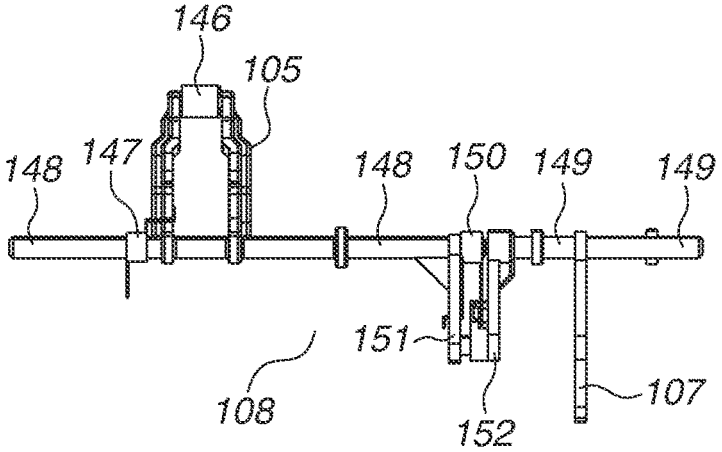
Figure 29C:
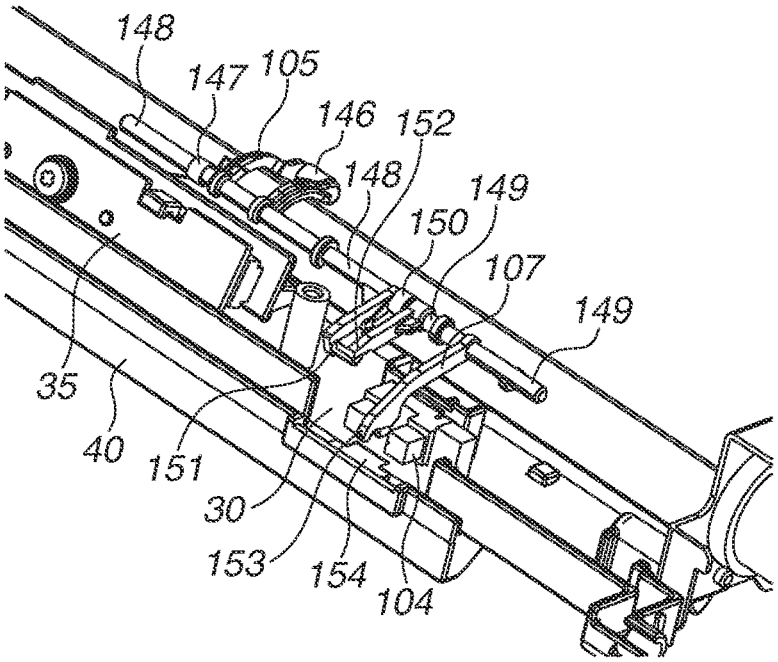

Next, a configuration of the contact type sensor is described. FIGS. 29A, 29B, and 29C are perspective views of the contact type sensor. An idler roller 146 is attached at a leading edge of the abutment portion 105 of the flag member 108 and has an effect to eliminate sliding damage to an image on a first surface at the time of two-sided printing. The rotation shaft 106 of the flag member 108 is rotatably held by the lid member 32, and thus the flag member 108 is held by the lid member 32. The abutment portion 105 is urged toward a home position by a coil spring 147.

According to the present exemplary embodiment, in order to make a rotation range (a rotation angle) of the light-blocking unit 107 smaller than a rotation range (a rotation angle) of the abutment portion 105, the abutment portion 105 and the light-blocking unit 107 are respectively integrated with different shafts on the rotation shaft 106. More specifically, the abutment portion 105 is integrated with a rotation shaft 148, and the light-blocking unit 107 is integrated with a rotation shaft 149. A coil spring 150 is attached to the rotation shaft 148 of the abutment portion 105. The coil spring 150 urges the rotating abutment portion 105 toward a home position direction when the light-blocking unit 107 becomes unmovable in the rotation direction. An abutting portion 151 is provided at an edge portion of the rotation shaft 148 of the abutment portion 105, and an abutting portion 152 is provided at an edge portion of the rotation shaft 149 of the light-blocking unit 107. The abutting portion 151 and the abutting portion 152 abut on each other. A photo-interrupter is used as the sensor member 104. The sensor member 104 is attached to the first guide unit 30. FIG. 29C illustrates a state in which the flag member 108 is located at the home position at which the sheet S is not detected.

Figure 30:
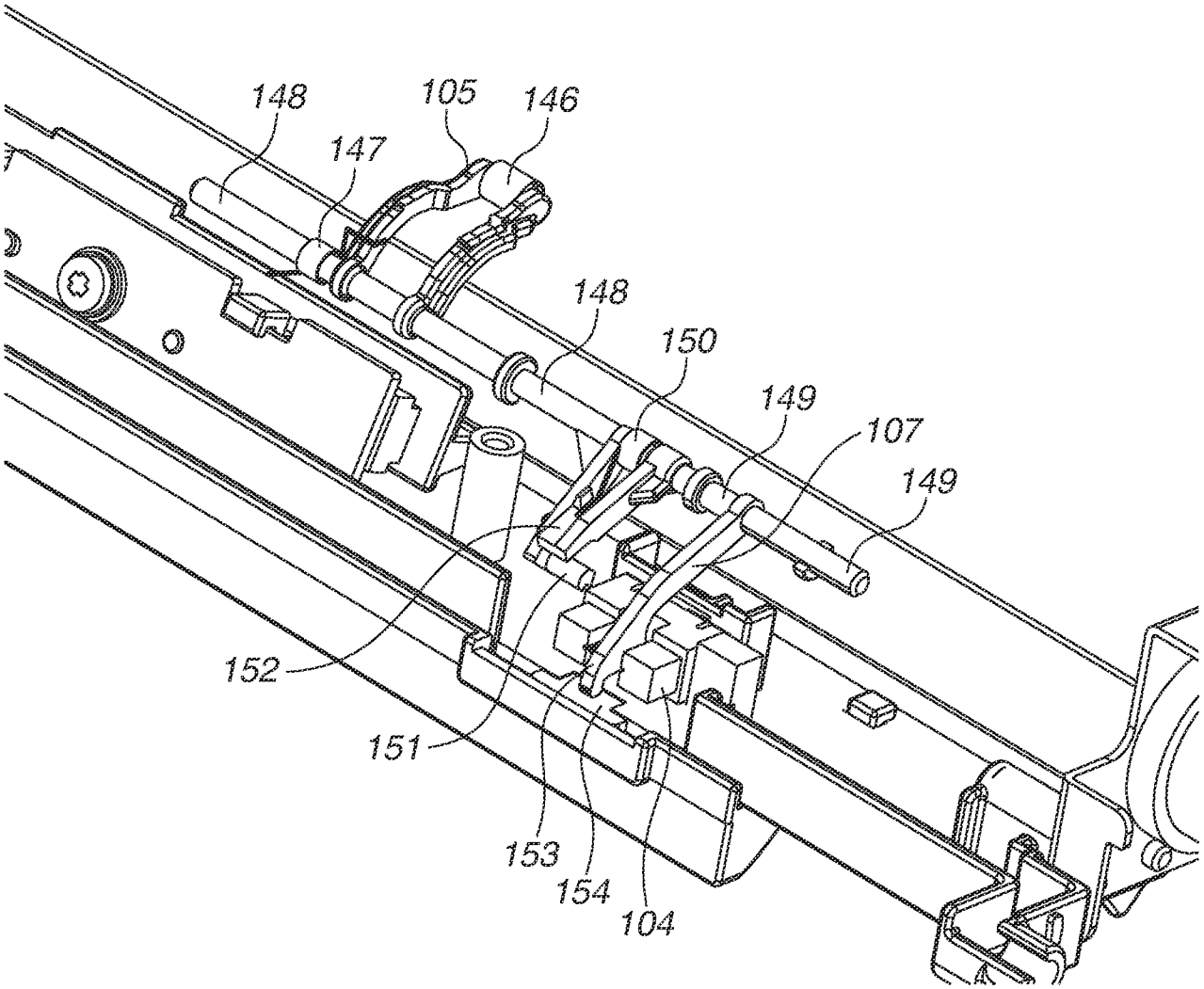
FIG. 30 is a perspective view of a sheet detecting state of the contact type sensor according to the sixth exemplary embodiment.

Next, operations of the above-described non-contact type sensor are described. FIG. 30 illustrates a state in which the sheet S is detected, and the flag member rotates. The abutment portion 105 is rotated by the sheet S, and thus the light-blocking unit 107 urged by the coil spring 147 also rotates toward the optical axis of the sensor member 104, and the light-blocking unit 107 blocks the optical axis at a predetermined angle. When the abutment portion 105 is further rotated, a protrusion portion 153 provided at the leading edge of the light-blocking unit 107 abuts on an abutting portion 154 provided to the first guide unit 30. When the abutment portion 105 is further rotated from this state by being pushed by the sheet, only the abutment portion 105 is rotated to make a gap between an abutting portion 151 and an abutting portion 152 against the force of the coil spring 150. After the sheet S passes through, the abutment portion 105 and the light-blocking unit 107 are rotated to directions urged by the coil springs 147 and 150 and return to the home positions.

As described above, the rotation angle of the light-blocking unit 107 is made smaller than the rotation angle of the abutment portion 105, and thus a space for disposing the light-blocking unit 107 can be reduced.

(Description of Jam Recovery at Sheet Discharge Unit and Fixing Unit)

Figure 31A:
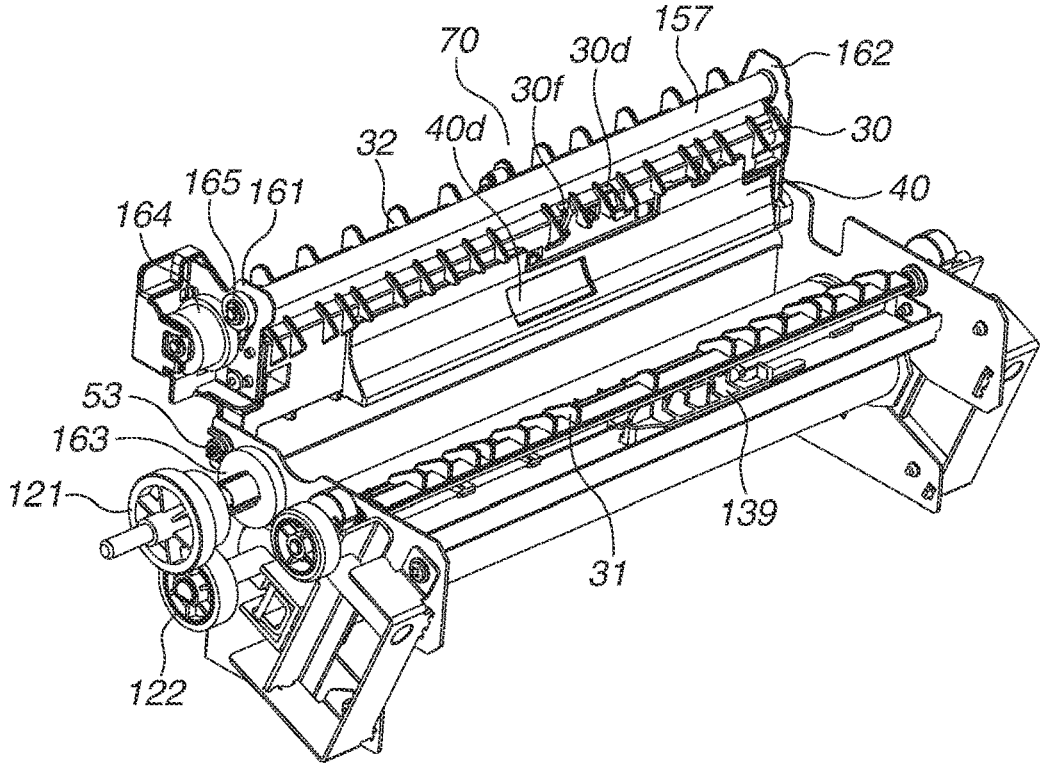
FIGS. 31A and 31B are perspective views of the fixing unit in a state in which a sheet discharge unit is opened according to the sixth exemplary embodiment.
Figure 31B:
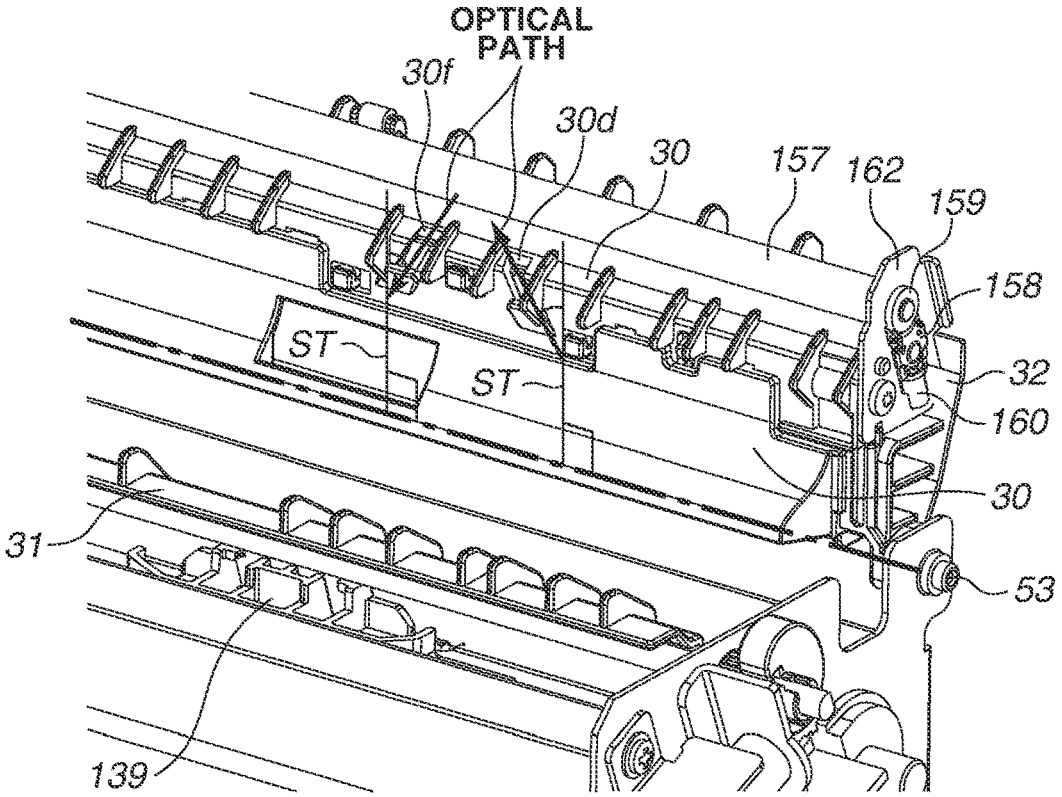

First, the sheet discharge unit 70 according to the present exemplary embodiment is described. FIGS. 31A and 31B illustrate a state in which the sheet discharge unit 70 is rotated with respect to the fixing unit 1. There is a rotation shaft 53 of the sheet discharge unit 70. Bundled wires coming out from the substrate 35 and the sensor member 104 pass through the rotation shaft 53 and are finally connected to the drawer connector 128. The sensors operate by being supplied with electricity from the image forming apparatus main body 100 via the drawer connector 128. The sheet discharge unit 70 is provided with the decurl roller pair 157, and the decurl roller pair 157 is rotatably supported by bearing portions 158 and 159. The bearing portion 158 is urged by a compression spring 160 toward an edge portion of the decurl roller pair 157, accordingly, a curl correction force of the decurl roller pair 157 is generated. The bearing portions 158 and 159 are attached to side plates 161 and 162, and the side plates 161 and 162 are fixed to the first guide unit 30. In order to drive the decurl roller pair 157, a driving force is transmitted from the gear 121 using gears 163, 164, and 165. In a state in which the sheet discharge unit 70 is rotated, the driving force is not transmitted to the decurl roller pair 157, and when the sheet discharge unit 70 is brought into a closed state with respect to the fixing unit 18, the gear 163 and the gear 164 engage with each other.

Next, jam recovery in the fixing unit 18 is described. As illustrated in FIGS. 31A and 31B, when jam recovery is performed, a user rotates the sheet discharge unit 70 to widen a space between the first guide unit 30 and the second guide unit 31. Accordingly, if a jam occurs in the fixing nip portion N, and the sheet S is creased in an accordion shape, jam recovery can be easily performed. However, when a jammed sheet S is removed from the fixing unit 18, it is highly possible that an unfixed toner, paper strip, and paper dust fall off from the sheet S. Thus, it is necessary to prevent, if the unfixed toner, paper strip, and paper dust fall off from the sheet S, them from adhering to the light-emitting unit 28 and the light-receiving unit 29 of the non-contact type sensor. If the unfixed toner, paper strip, and paper dust adhere to the light-emitting unit 28 and the light-receiving unit 29, the sensor may cause erroneous detection. Thus, according to the present exemplary embodiment, as illustrated in FIG. 31B, the optical paths of the light-emitting unit 28 and the light-receiving unit 29 are inclined relative to a direction ST perpendicular to the rotation shaft 53 when the sheet discharge unit 70 is opened with respect to the fixing unit 18. With reference to FIG. 28, the optical paths are not perpendicular to the sheet S surface. Since in such configuration, if the unfixed toner, paper strip, and paper dust fall off from the sheet S, they adhere only on the first guide unit 30 or the substrate holder 131 and can be suppressed from adhering to the light-emitting unit 28 and the light-receiving unit 29.

According to the present exemplary embodiment, the reflection member 36 is used in the non-contact type sensor, however, a configuration for detecting the sheet S by reflecting light on the sheet S surface and a configuration for detecting the sheet S by arranging the light-emitting unit 28 and the light-receiving unit 29 across the sheet conveyance path can obtain the similar effects if the optical path is formed to be inclined relative to a direction perpendicular to the rotation shaft in a state in which a sheet conveyance guide is moved to a direction widening a space of the sheet conveyance path.

Figure 32:
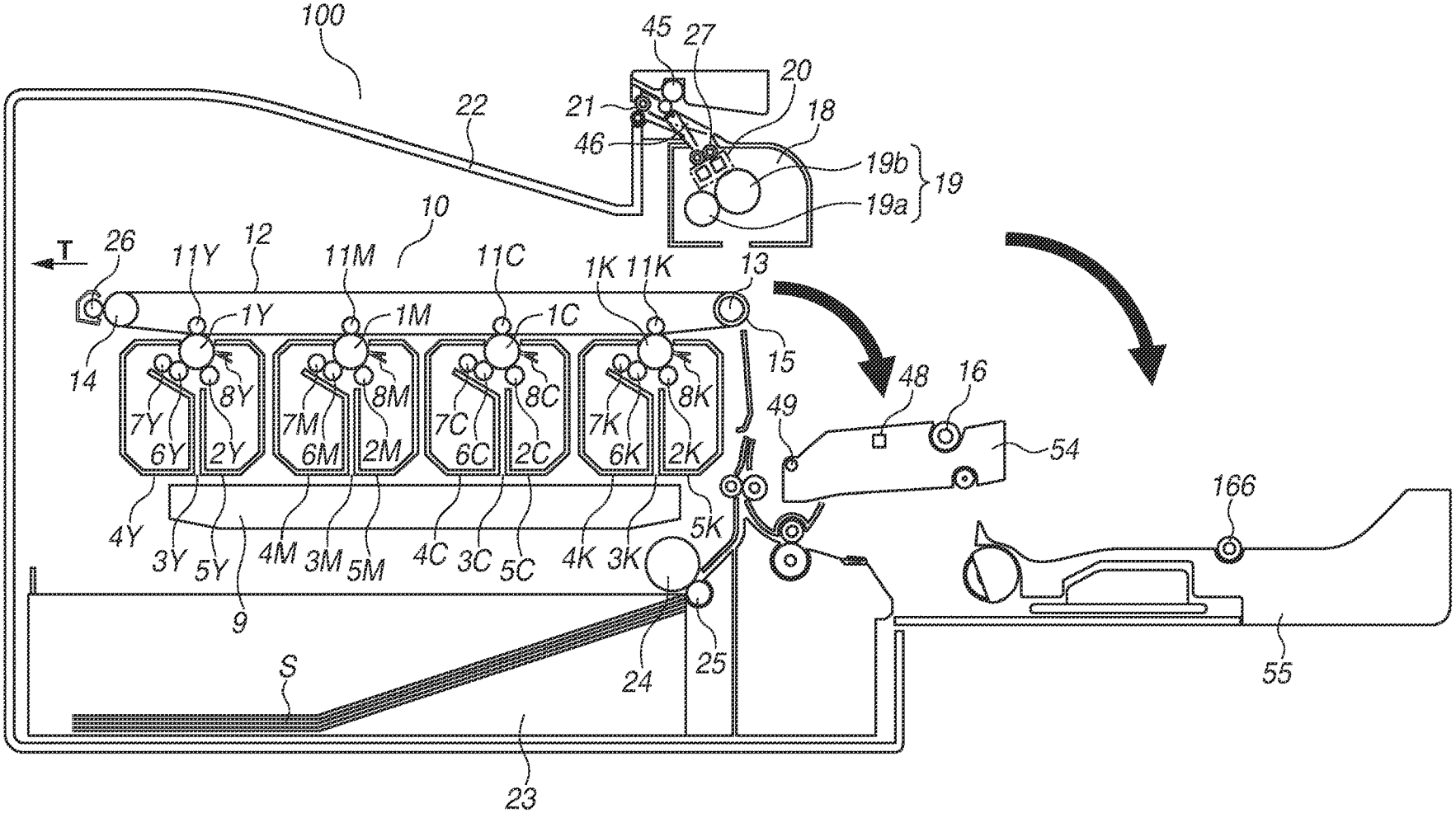
FIG. 32 is a cross-sectional view of a case in which the configuration according to the sixth exemplary embodiment is used in a secondary transfer guide.

Further, according to the present exemplary embodiment, the non-contact type sensor is installed in the fixing unit 18, however, the present disclosure can be applied to the non-contact type sensor installed in a unit other than the fixing unit. For example, as illustrated in FIG. 2, a secondary transfer guide 54 including the secondary transfer roller 16 is provided with a non-contact type sensor 48 therein for detecting presence or absence of the sheet S conveyed from the registration roller pair 17 to the secondary transfer unit 15. The non-contact type sensor 48 detects the sheet by reflecting the light from the light-emitting unit 28 on the sheet S surface. A configuration for jam recovery when a jam occurs near the above-described non-contact type sensor 48 is described with reference to FIG. 32. FIG. 32 illustrates a state of the secondary transfer guide 54 when jam recovery is performed. First, a right door cover 55 is opened, and the secondary transfer guide 54 is exposed. The secondary transfer guide 54 has a rotation shaft 49, and the secondary transfer guide 54 is rotated centering around the rotation shaft 49. Accordingly, the jam occurred in the secondary transfer guide 54 can be easily removed. In addition, the optical paths of the light-emitting unit and the light-receiving unit 29 of the non-contact type sensor 48 are configured to be inclined relative to a direction perpendicular to the rotation shaft 49. Accordingly, the unfixed toner, paper strip, and paper dust can be prevented from adhering to the light-emitting unit and the light-receiving unit of the non-contact type sensor 48 installed in the secondary transfer guide 54.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

What is claimed is:

1. An image forming apparatus comprising:

an image forming unit configured to form a toner image on a sheet, and a fixing unit configured to fix the toner image formed on the sheet onto the sheet, the fixing unit including a heating unit for heating the toner image;

a pressure roller unit for forming a fixing nip portion for nipping and conveying the sheet in cooperation with the heating unit;

a guide unit disposed downstream of the fixing unit in a sheet conveyance direction in which the sheet moves and configured to guide the sheet nipped by the fixing nip portion, wherein the guide unit includes a first guide member and a second guide member facing the first guide member across a space in which the sheet moves, and wherein the first guide member is located on a side where the pressure roller unit is located, and the second guide member is located on a side where the heating unit is located, across the space located therebetween;

a first sensor unit configured to detect the sheet moving along the space, wherein the first sensor unit includes a light-emitting unit and a light-receiving unit, and the light-receiving unit receives light emitted from the light-emitting unit;

a reflecting member configured to reflect, toward the light-receiving unit, the light emitted from the light-emitting unit, a pair of rollers disposed downstream of the fixing nip in the sheet conveyance direction; and a second sensor unit disposed downstream of the pair of rollers in the sheet conveyance direction and configured to detect the sheet by coming into contact with the sheet, wherein the second sensor unit includes a flag member which is movable by coming into contact with the sheet, and a sensor member whose transmission state is changed by the flag member, wherein the light-emitting unit is disposed inside the first guide member, the reflecting member is disposed inside the second guide member, and the light-emitting unit is disposed between the fixing nip and the pair of rollers in the sheet conveyance direction, wherein the pair of rollers, the light-emitting unit, the first guide member, and the flag member are integrally configured as a discharge unit, and wherein the discharge unit is rotatable relative to the fixing unit.

2. The image forming apparatus according to claim 1, wherein the reflecting member is a sheet metal.

3. The image forming apparatus according to claim 2, wherein a material of the sheet metal is stainless steel.

4. The image forming apparatus according to claim 1, further comprising a light-blocking portion configured to block and prevent light emitted from the light-emitting unit and then reflected by the sheet from going toward the light-receiving unit.

5. The image forming apparatus according to claim 4, wherein the light-blocking portion is a rib disposed on the first guide member.

6. The image forming apparatus according to claim 1, wherein, in a vertical direction, the first sensor unit is disposed above the pressure roller unit, and the reflecting member is disposed above the heating unit.

7. The image forming apparatus according to claim 1, wherein the first guide member includes a first opening on a path of the light emitted from the light-emitting unit toward the reflecting member and a second opening on a path of the light reflected by the reflecting member toward the light-receiving unit.

8. The image forming apparatus according to claim 7, wherein the first guide member is rotatable between a position where the first guide member and the second guide member face each other across the space and a position for opening the space.

9. The image forming apparatus according to claim 8, wherein the first opening and the second opening are inclined relative to a direction perpendicular to a rotation shaft of the first guide member.

10. The image forming apparatus according to claim 1, wherein the pair of rollers is a pair of decurl rollers configured to correct curl of a sheet.

* * * * *